US007116791B2

(12) United States Patent
Matsuo

(10) Patent No.: US 7,116,791 B2
(45) Date of Patent: Oct. 3, 2006

(54) MICROPHONE ARRAY SYSTEM

(75) Inventor: Naoshi Matsuo, Kanagawa (JP)

(73) Assignee: Fujitsu Limited, Kawasaki (JP)

( * ) Notice: Subject to any disclaimer, the term of this patent is extended or adjusted under 35 U.S.C. 154(b) by 86 days.

(21) Appl. No.: 10/721,067

(22) Filed: Nov. 26, 2003

(65) Prior Publication Data

US 2004/0105557 A1 Jun. 3, 2004

Related U.S. Application Data

(62) Division of application No. 09/560,355, filed on Apr. 28, 2000, now Pat. No. 6,694,028.

(30) Foreign Application Priority Data

Jul. 2, 1999 (JP) ..... 11-189494

(51) Int. Cl.
*H04R 3/00* (2006.01)

(52) U.S. Cl. ..... 381/92; 348/14.08

(58) Field of Classification Search ..... 381/92, 381/356, 357, 122; 348/14.08
See application file for complete search history.

(56) References Cited

U.S. PATENT DOCUMENTS 5,675,655 A * 10/1997 Hatae ..... 381/26
5,787,183 A * 7/1998 Chu et al. ..... 381/92
6,069,961 A 5/2000 Nakazawa
6,173,059 B1 * 1/2001 Huang et al. ..... 381/92
6,243,471 B1 * 6/2001 Brandstein et al. ..... 381/92
6,469,732 B1 * 10/2002 Chang et al. ..... 348/14.08

FOREIGN PATENT DOCUMENTS

JP 10-215497 8/1998

* cited by examiner

*Primary Examiner*—Brian T. Pendleton
(74) *Attorney, Agent, or Firm*—Armstrong, Kratz, Quintos, Hanson & Brooks, LLP

(57) ABSTRACT

The present invention provides a sound signal processing function comprising a plurality of kinds of sound signal processing with the same arrangement of microphones that does not require replacement of the microphones or the sound signal processing part regardless of the application or the sound signal processing function.

The present invention uses an apparatus having a signal processing function such as a personal computer as the platform. An array section includes a plurality of microphones arranged in the X and Y axis directions. A received sound signal from each direction is subjected to a delay process by a delay unit, a subtraction process by subtracters 121 and 122, so as to obtain a received sound signal with a unidirectional pattern to the direction of the front of the apparatus and a received sound signal with a bidirectional pattern to the directions orthogonal thereto. In the case where the sound source is not in the direction of the front, a correction process to direct the sound source to the front is performed by a delay unit, a subtracter and adjustment of the gain amount. The directional sound signal calculating part, the sound source direction detecting part, and the noise suppressing part have a logic necessary to implement various functions using the uni/bidirectivity pattern signal as the input.

6 Claims, 19 Drawing Sheets

(B)

(A)

| | $\frac{\text{Bidirectional microphone input signal power}}{\text{Unidirectional microphone input signal power}}=(P)$ | Cross-correlation coefficient (R) |
|---|---|---|
| 0° | $P<T_P$ | $T_{R1}<R\leqq T_{R2}$ |
| 90° | $P\geqq T_P$ | $R>T_{R2}$ |
| 180° | $P\geqq T_P$ | $T_{R1}<R\leqq T_{R2}$ |
| 270° | $P\geqq T_P$ | $R\leqq T_{R1}$ |

FIG. 12

| Orientation of a camera 160 | The delay sampling number | The amount of gain adjustment |
|---|---|---|
| 0° | Delay unit 110c:1<br>Delay unit 110a,b,d:0 | 150a,b,e,g,h:+1.0<br>150c,d,f:−1.0 |
| 90° | Delay unit 110d:1<br>Delay unit 110a,b,c:0 | 150b,c,f,g,h:+1.0<br>150a,d,e:−1.0 |
| 180° | Delay unit 110a:1<br>Delay unit 110b,c,d:0 | 150c,d,e,g,h:+1.0<br>150a,b,f:−1.0 |
| 270° | Delay unit 110b:1<br>Delay unit 110a,c,d:0 | 150a,d,f,g,h:+1.0<br>150b,c,e:−1.0 |

FIG . 16

MICROPHONE ARRAY SYSTEM

CROSS REFERENCE TO RELATED APPLICATION

This is a Divisional Application of U.S. patent application Ser. No. 09/560,355 filed Apr. 28, 2000 now U.S. Pat. No. 694,028.

BACKGROUND OF THE INVENTION

1. Field of the Invention

The present invention relates to a microphone array system. In particular, the present invention relates to a system that performs various kinds of signal processing with respect to sound signals received at each microphone to provide various functions.

2. Description of the Related Art

Hereinafter, a sound signal processing technique that utilizes a conventional technique will be described.

In the case where a plurality of sound sources of a desired signal and noise are present in a sound field, high quality enhancement of the desired sound, detection of the direction of the desired sound and noise suppression are important issues to be addressed for sound signal processing. Possible applications that utilize sound signal processing are in a wide range, such as animation and sound recording, systems for voice memo, hand-free telephones, teleconference systems, guest-reception systems or the like. In order to realize processing for enhancing a desired signal, suppressing noise and detecting the direction of the sound source, various sound signal processing techniques are under development.

Conventionally, microphones suitable for a particular application are used to obtain input sound signals for use in the processing for enhancing a desired signal, suppressing noise and detecting the direction of the sound source. For a compact video camera, a stereo microphone of MS (mid-side) system is widely used. In recent years, a unidirectional microphone is used in a personal computer that utilizes sound input in application software such as a voice memo, so that a suitable and articulate input sound signal can be obtained. Although these microphone are suitably used in view of the use and the cost, they are intended for a single use so that the directivity or the use is predetermined. Moreover, the processing of the sound signals received at the microphones is limited to the sound signal processing required by the application.

In an apparatus such as a conventional video camera or sound-inputtable personal computer that requires microphones suitable to each application and implements only sound signal processing required by the application that currently runs, the microphone and the sound signal processing function are each intended for a single function. However, for the apparatus designed to have a large number of functions, more flexible directionally received sound processing, sound source direction detecting processing and noise suppressing processing are desirable, and a function that has not conventionally required may be required in an application. In this case, since the configuration of the apparatus using the conventional microphone with a single function cannot meet this need, it is necessary to replace the microphone by a microphone suitable to the required function and also to replace the sound signal processing part for received sound signals by another one having the required function.

As the utilization system is varied, combining a plurality of kinds of sound signal processing such as directionally received sound processing, sound source direction detecting processing, noise suppressing processing and the like may be needed. In this case, it is necessary to prepare a plurality of microphones, each of which has a single function, and to perform sound signal processing for each individual microphone, and then perform sound signal processing of the combined results from the plurality of microphones. Thus, this conventional system requires a large number of microphones, so that it results in a large-scale apparatus. Furthermore, it may be difficult to physically arrange the required number of microphones to perform a plurality of kinds of sound signal processing in the necessary directions.

SUMMARY OF THE INVENTION

Therefore, with the foregoing in mind, it is an object of the present invention to provide a microphone array system that eliminates the replacement of the microphones and the replacement of the sound signal processing parts, which are conventionally required, regardless of the variation of the application or the sound signal processing function. It is another object of the present invention to achieve a sound signal processing function performing a combination of various kinds of sound signal processing in the same microphone arrangement.

A microphone array system using a unit having a signal processing function such as a personal computer as the platform includes at least one microphone arranged along each axis direction; and a received sound signal processing part for performing signal processing of sound signals received at the plurality of microphones, having a directional sound signal calculating function for calculating a directional sound signal to an arbitrary direction based on the received sound signal with a unidirectivity or bidirectivity pattern along the axis direction, and further having at least one function of other sound signal processing functions at the same time. It is preferable that the other sound signal processing functions includes a sound source direction detecting function and a noise suppressing function.

This embodiment achieves a microphone array system including a plurality of microphones using a personal computer and allows the system to have a plurality of sound signal processing functions including the function for calculating a directional sound signal to an arbitrary direction, the sound source direction detecting function and the noise suppressing function based on the processing of sound signals received at the microphone array.

In one embodiment, the plurality of microphones are non-directional microphones, at least two non-directional microphones are arranged in a first axis direction, and at least two non-directional microphones are arranged in a second axis direction that is orthogonal to the first axis. This makes it possible that the received sound signal processing part has a function for calculating a directional sound signal to an arbitrary direction based on a unidirectional estimated sound signal to a positive direction on the first axis and a bidirectional estimated sound signal to positive and negative directions on the second axis. In another embodiment, the plurality of microphones are unidirectional microphones, a first unidirectional microphone is directed to a positive direction on a first axis, and second and third unidirectional microphones are directed to positive and negative directions on a second axis that is orthogonal to the first axis. This makes it possible that the received sound signal processing part has a function for calculating a directional sound signal to an arbitrary direction based on a unidirectional received sound signal to a positive direction on the first axis and a bidirectional received sound signal to positive and negative directions on the second axis. In still another embodiment, the plurality of microphones are at least one unidirectional microphone and at least one bidirectional microphone, the unidirectional microphone is directed to a first axis direction, and the bidirectional microphone is directed to a second axis direction that is orthogonal to the first axis direction. This makes it possible that the received sound signal processing part has a function for calculating a directional sound signal to an arbitrary direction based on a unidirectional received sound signal to a positive direction on the first axis and a bidirectional received sound signal to positive and negative directions on the second axis. Furthermore, it is possible that the received sound signal processing part has a sound source direction detecting function for detecting a sound source direction, using a power in each axis direction of a sound signal calculated by the directional sound signal calculating function and cross-correlation thereof.

The microphone array system of the present invention can have the function for calculating a directional sound signal to an arbitrary direction and further have sound signal processing functions such as the function for detecting a sound source direction and the function for suppressing noise based on a plurality of kinds of processing of sound signals received at the microphone array by providing a plurality of microphones on a personal computer, which is the platform, regardless of the application or the sound signal processing function.

The microphone array system of the present invention can have the function for calculating a directional sound signal to an arbitrary direction based on a unidirectional estimated sound signal to the positive direction of the first axis and a bidirectional estimated sound signal to the positive and negative directions of the second axis.

The microphone array system of the present invention can have the sound source direction detecting function for detecting the sound source direction using the powers of the sound signals on the axes that are calculated by the directional sound signal calculating function and the cross-correlation coefficient therebetween.

These and other advantages of the present invention will become apparent to those skilled in the art upon reading and understanding the following detailed description with reference to the accompanying figures.

BRIEF DESCRIPTION OF THE DRAWINGS

FIG. 12 is a diagram showing the pattern classification of sound source directions by the comparison of the power ratio P of the unidirectivity and the bidirectivity and the threshold Tp and the comparison of the cross-correlation coefficient and the thresholds TRI and TR2 according to the microphone array system of the present invention.

FIG. 16 is a diagram showing the adjustment of the delay sampling number of the delay units and the gain amount of the gain circuits based on the camera image capturing direction of Embodiment 4 of the present invention.

DESCRIPTION OF THE PREFERRED EMBODIMENTS

Hereinafter, the embodiments of the microphone array system of the present invention will be described with reference to the accompanying drawings.

Embodiment 1

The microphone array system of Embodiment 1 includes a microphone array where a plurality of microphones are arranged along the axis direction, using a personal computer as the platform. The system performs signal processing of sound signals received at these microphones to generate received sound signals with a unidirectivity or bidirectivity pattern along the axis direction. The system includes a directional sound signal calculating function for calculating a directional sound signal to an arbitrary direction based on the generated received sound signals, and further include a sound source direction detecting function, a noise suppressing function and a sound signal processing function.

Figure 1:
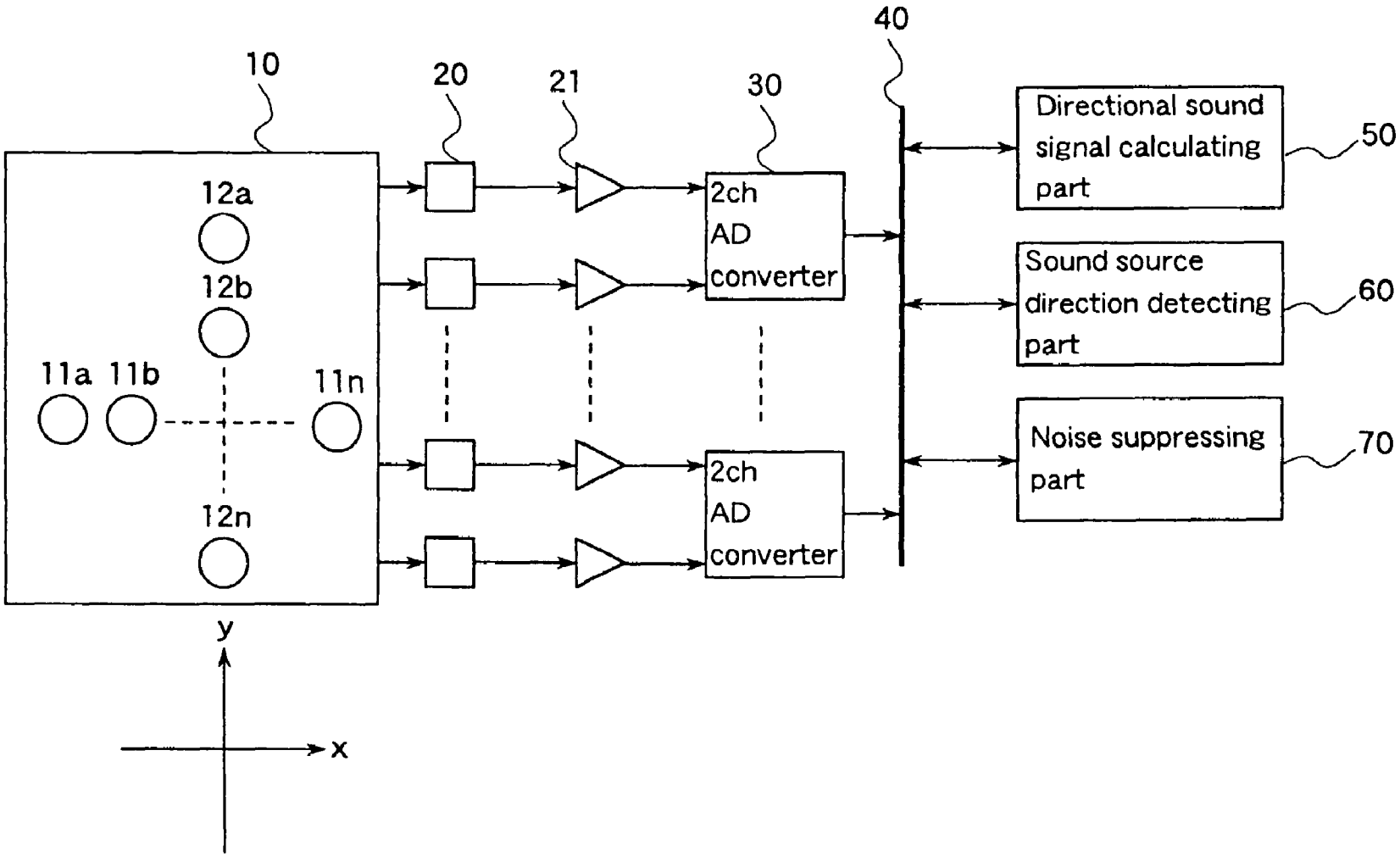
FIG. 1 is a diagram showing an example of the configuration of a microphone array where a plurality of microphones are arranged along the axis direction using a personal computer as the platform of the present invention.

FIG. 1 is a diagram showing an example of the configuration of a microphone array where a plurality of microphones are arranged along the axis directions, using a personal computer as the platform. In this example, two orthogonal axes of the X axis and the Y axis as shown in FIG. 1 are used as the axis. Three axes of X, Y and Z can be used, and the axes are not necessarily orthogonal.

A microphone array section 10 includes a plurality of microphones 11 arranged on the X axis and a plurality of microphones 12 arranged on the Y axis. The microphones 11 and 12 can be either non-directional, unidirectivity or bidirectional microphones. A sound signal received from each microphone is sent through analog microphone interfaces including a connector 20, a microphone amplifier 21, a two channel analog-digital converter 30 (hereinafter, referred to as "AD converter"), and thus the received sound signals are connected to a directional sound signal calculating part 50, a sound source direction detecting part 60, and a noise suppressing part 70 via a bus 40 of the platform personal computer. The directional sound signal calculating part 50, the sound source direction detecting part 60, and the noise suppressing part 70 can be an independent device dedicated to the particular function, or can be designed as a processing program that is described so that the particular function is realized by the central processing unit (hereinafter, referred to as CPU) and the memory of the platform personal computer.

Figure 2:
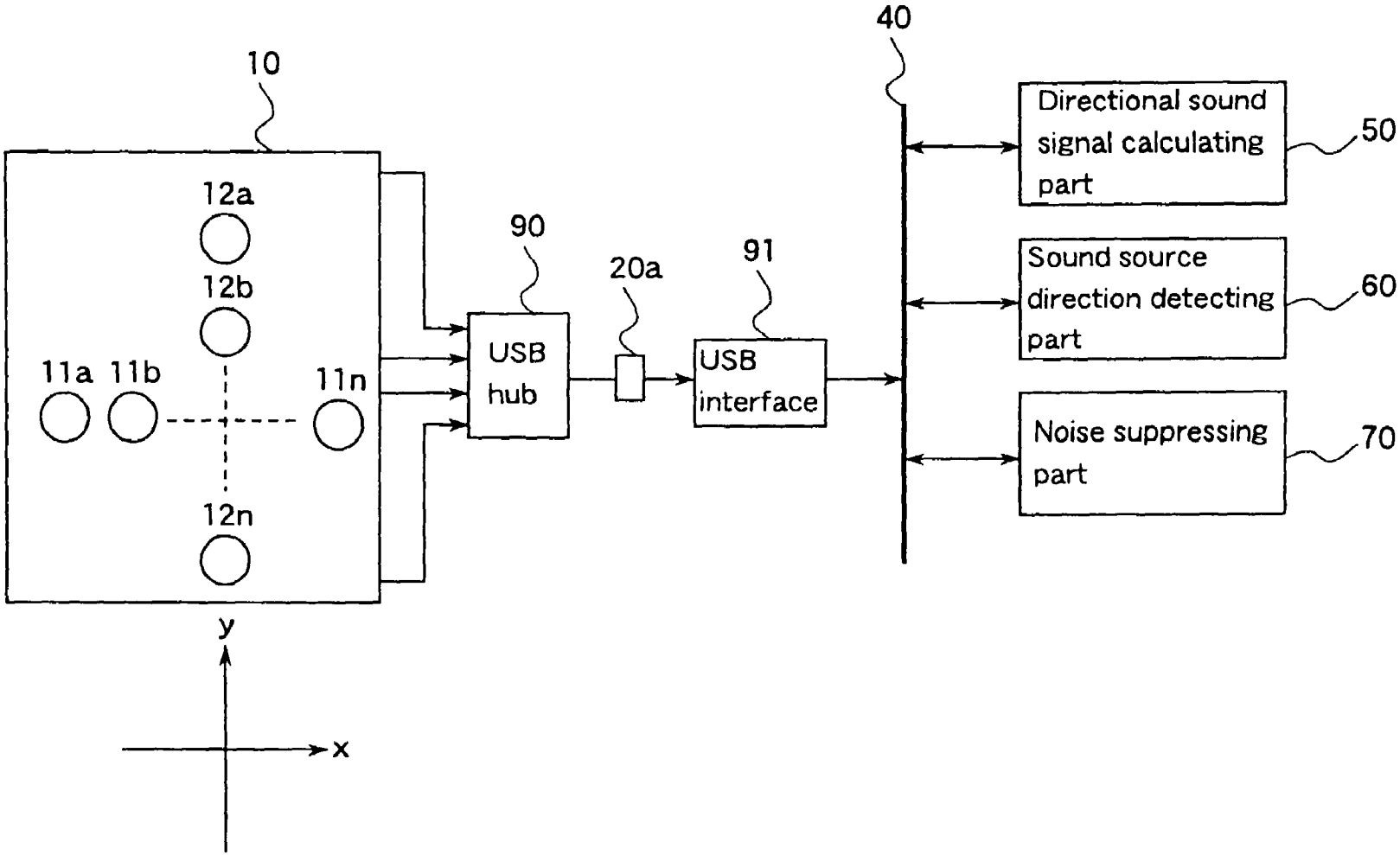
FIG. 2 is a diagram showing an example of a configuration different from that of FIG. 1 of a microphone array of the present invention.

FIG. 2 is a diagram showing a microphone array with a configuration different from that of FIG. 1. In this example, a USB (universal serial bus) interface is used as the interface of the microphone. In this example as well, two axes of X and Y as shown in FIG. 1 are used as the axis. In the example shown in FIG. 2, the microphones 11 and 12 of the microphone array section 10 can be arranged in the same manner as in the example in FIG. 1. Each of the microphones 11 and 12 is connected to a bus 40 via a USB hub 90, a connector 20a and a USB interface 91 and connected to a directional sound signal calculating part 50, a sound source direction detecting part 60, and a noise suppressing part 70.

All of these functions are not necessarily provided in the system. For example, the directional sound signal calculating part and only one other function may be combined. Alternatively, all the functions may be combined, and other sound signal processing functions can be added thereto.

Next, sound signal processing of the directional sound signal calculating function, the sound source direction detecting function, the noise suppressing function of the microphone array system of the present invention will be described with reference to the arrangement examples of the microphones.

Figure 3:
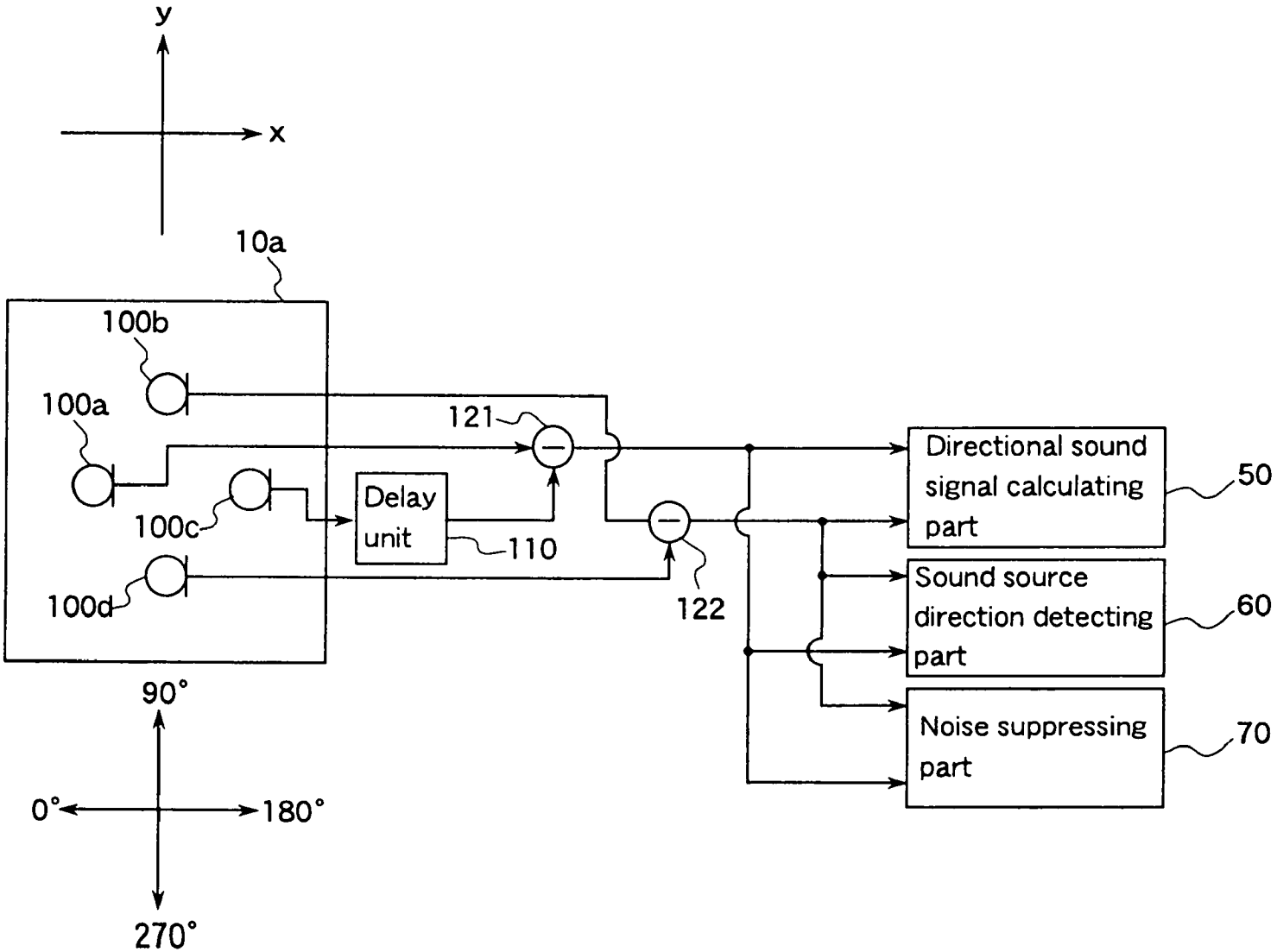
FIG. 3 is a diagram illustrating the principle of processing for calculating directional sound signals by the microphone array system of the present invention.

In a microphone array section 10*a* of the example shown in FIG. 3, four non-directional microphones 100*a* to 100*d* are arranged along the positive and negative directions of the X and Y axes, each microphone corresponding to one direction, to receive sound signals. The direction of the front of the microphone array system corresponds to the negative direction on the X axis. The microphones 100*a* to 100*d* are positioned close to each other. In this example, the distance between the microphones 100*a* and 100*c* and the distance between the microphones 100*b* and 100*d* are a value obtained by dividing the sound velocity by the sampling frequency. A delay unit 110 performs processing of delaying for one sampling period and is connected to the microphone 100*c*. Numerals 121 and 122 denote subtracters.

Figure 4:
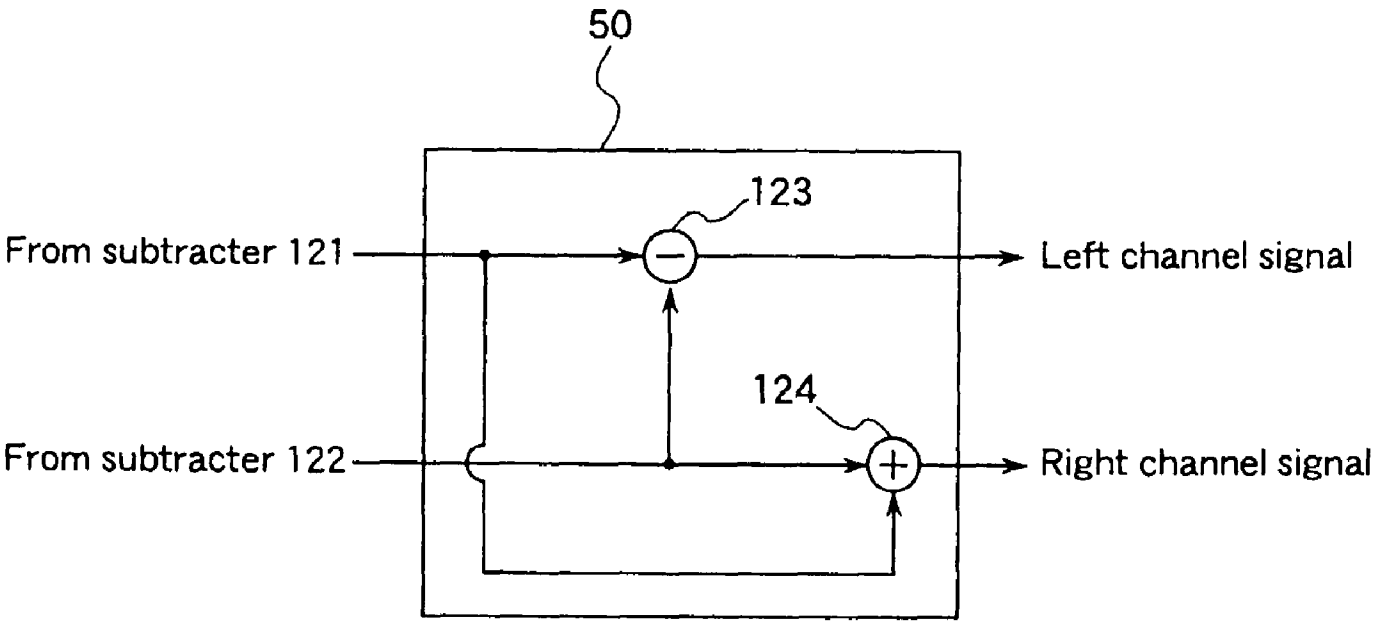
FIG. 4 is a diagram showing an example of the configuration of a directional sound signal calculating part 50.

The directional sound signal calculating function will be described primarily from the aspect of the directional sound signal calculating part 50. FIG. 4 is a diagram showing an example of the configuration of a directional sound signal calculating part 50.

In the first stage, the directional sound signal calculating function generates a received sound signal from a microphone whose directivity has a unidirectivity pattern to the negative direction on the X axis and a received sound signal from a microphone whose directivity has a bidirectivity pattern to the positive and negative directions on the Y axis. Next, in the second stage, the directional sound signal calculating function estimates a left (L) channel signal and a right (R) channel signal having the directivity to a particular direction, based on the received sound signals with a unidirectivity pattern to the negative direction on the X axis and the received sound signal with a bidirectivity pattern to the positive and negative directions on the Y axis.

First, the process in the first stage will be described.

Figure 5:
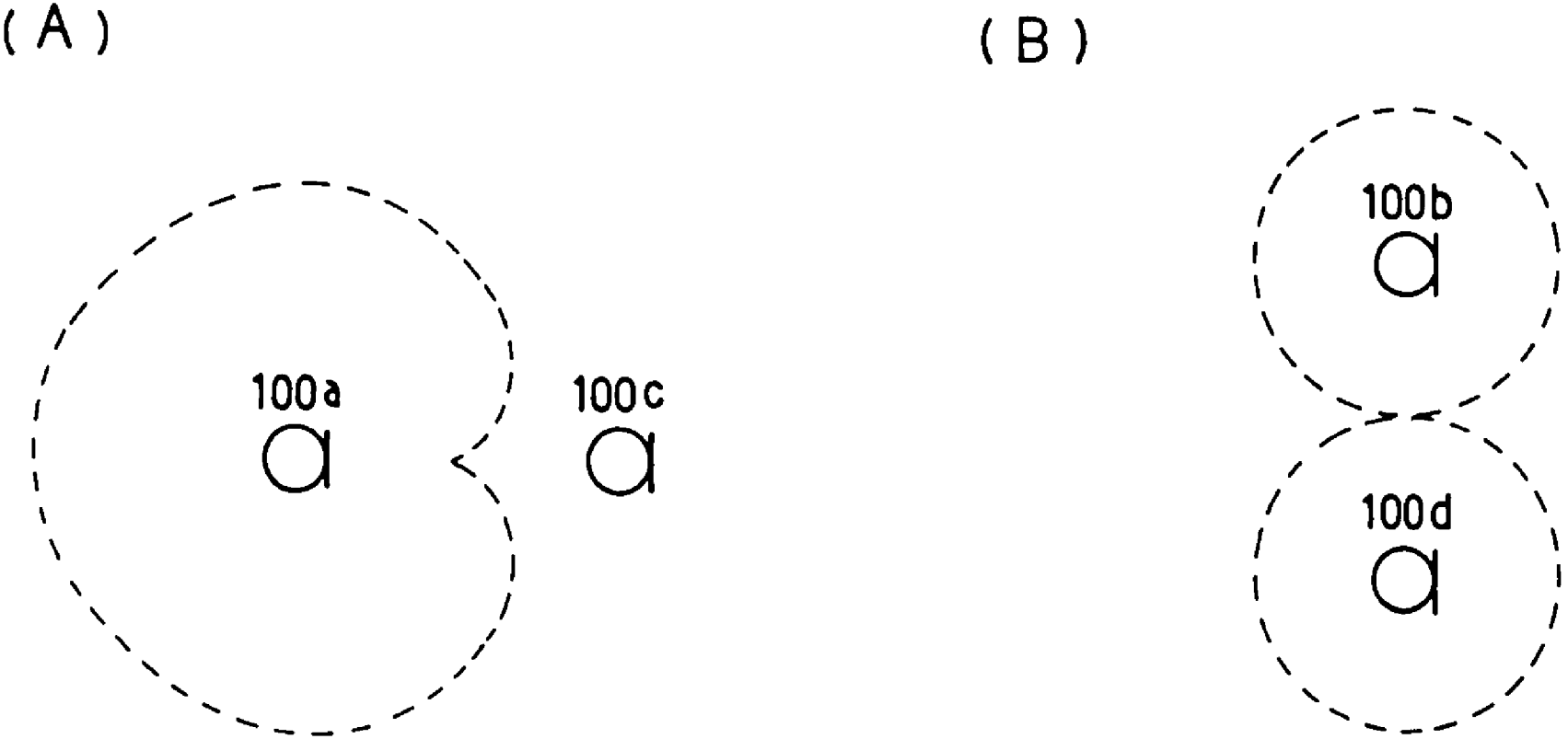
FIGS. 5A and 5B are diagrams showing a received sound signal with a unidirectivity pattern to the negative direction on the X axis and a received sound signal with a bidirectivity pattern to the positive and negative directions on the Y axis obtained by the microphone array system of the present invention.

As shown in FIG. 3, the subtracter 121 subtracts the received sound signal of the microphone 100*c* that is delayed by one sampling period by the delay unit 110 from the received sound signal of the microphone 100*a*. As a result, a received sound signal having a unidirectivity pattern to the negative direction on the X axis as shown in FIG. 5A is generated. Furthermore, the subtracter 122 subtracts the received sound signal of the microphone 100*d* from the received sound signal of the microphone 100*b*. As a result, a received sound signal having a bidirectivity pattern to the negative and positive directions on the Y axis as shown in FIG. 5B is generated. In FIG. 5B, the positive direction on the Y axis corresponds to the plus directivity, and the negative direction on the Y axis corresponds to the minus directivity.

Next, the process in the second stage will be described.

Figure 6:
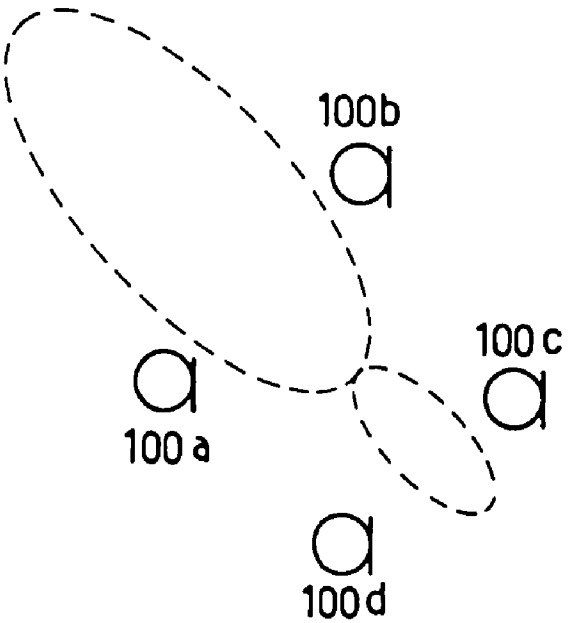
FIGS. 6A and 6B are diagrams showing a received sound signal with a directivity pattern for left channel signal reception and a received sound signal with a directivity pattern for right channel signal reception of two channel stereo sound reception that are estimated by the microphone array system of the present invention, respectively.
Figure 6:
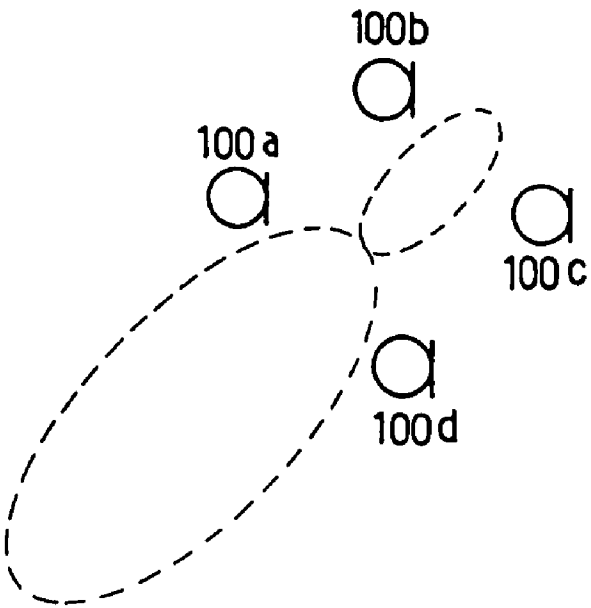

The process for generating a received sound signal having a directivity pattern to the left channel direction will be described below. As shown in FIG. 4, the received sound signal having a unidirectivity pattern of FIG. 5A, which is an output signal from the subtracter 121, and the received sound signal having a bidirectivity pattern of FIG. 5B, which is an output signal from the subtracter 122, are input to a subtracter 123 of the directional sound signal calculating part 50, and the latter is subtracted from the former. This subtraction provides a received sound signal having a directivity pattern for left channel signal reception for two channel stereo sound reception as shown in FIG. 6A. FIG. 6A shows a directivity pattern having an angle of about 45° with respect to the front direction. However, this angle is adjustable so that a directivity pattern to an arbitrary direction can be obtained. In other words, a directivity pattern to an arbitrary direction can be obtained by adjusting the gains of the output signals from the subtracters 121 and 122, and then inputting the results to the subtracter 123 for a subtraction process. For example, the gain of the output signal from the subtracter 121 is enlarged, and the gain of the output signal from the subtracter 122 is reduced, and then the subtracter 123 subtracts the latter from the former. In this case, the directivity of the obtained directivity pattern becomes near the front direction, compared to the directivity pattern shown in FIG. 6A.

The process for generating a received sound signal having the directivity pattern to the right channel direction will be described below. A received sound signal having a unidirectivity pattern of FIG. 5A, which is an output signal from the subtracter 121, and a received sound signal having a bidirectivity pattern of FIG. 5B, which is an output signal from the subtracter 122, are input to an adder 124, and the former and the latter are added. This addition provides a received sound signal having a directivity pattern for right channel signal reception for two channel stereo sound reception as shown in FIG. 6B. Similarly to the case of the left channel, it is possible to adjust the angle of the pattern with the plus directivity and the minus directivity.

Next, the sound source direction detecting function will be described primarily from the aspect of the sound source direction detecting part 60. The sound source direction detection is performed by utilizing the powers of the received sound signal with the unidirectivity pattern to the negative direction on the X axis (front direction) and the received sound signal with the bidirectivity pattern to the positive and negative directions on the Y axis, and the cross-correlation coefficient therebetween.

Figure 7:
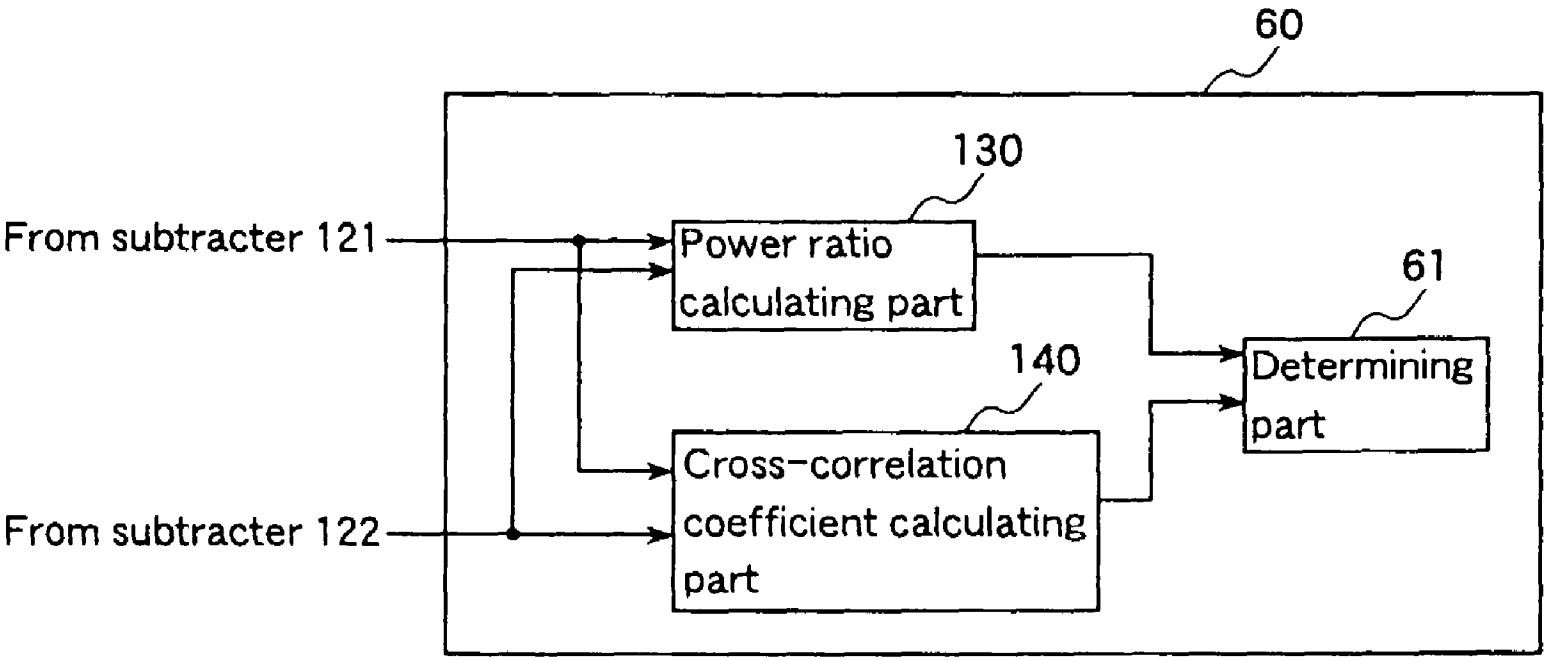
FIG. 7 shows an example of the configuration of the sound source direction detecting part 60.

FIG. 7 shows an example of the configuration of the sound source direction detecting part 60. The sound source direction detecting part 60 includes a power ratio calculating part 130, a cross-correlation coefficient calculating part 140, and a determining part 61. The sound source direction detecting part 60 receives a received sound signal having a unidirectivity pattern to the negative direction on the X axis as shown in FIG. 5A from the subtracter 121 and a received sound signal having a bidirectivity pattern to the positive and negative directions on the Y axis as shown in FIG. 5B from the subtracter 122.

Figure 8:
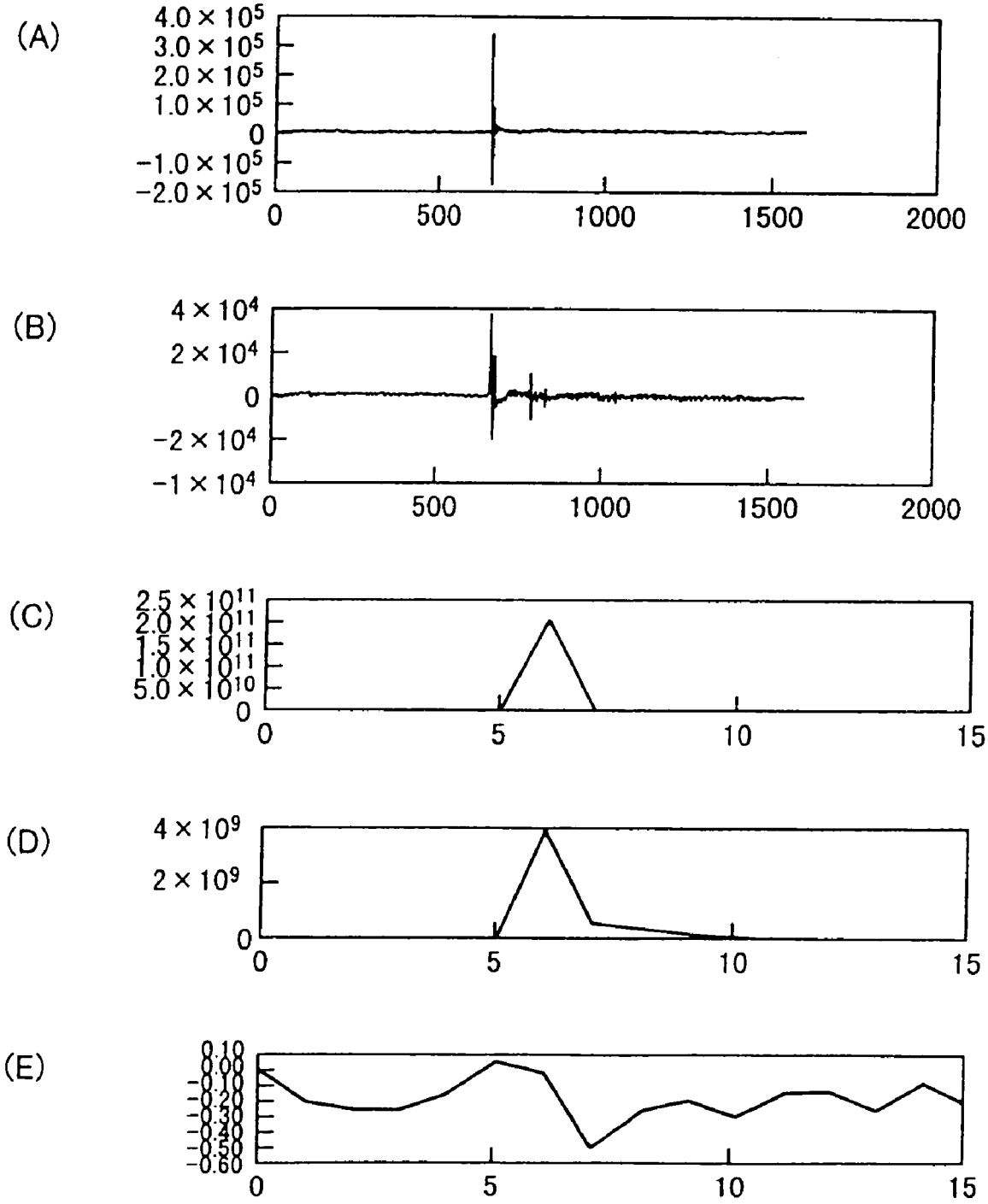
FIGS. 8A to 8E are diagrams showing a received sound signal with a unidirectivity pattern processed by the subtracter 121 and a received sound signal with a bidirectivity pattern processed by the subtracter 122 with respect to an impulse sound source from the negative direction on the X axis according to the microphone array system of the present invention.
Figure 9:
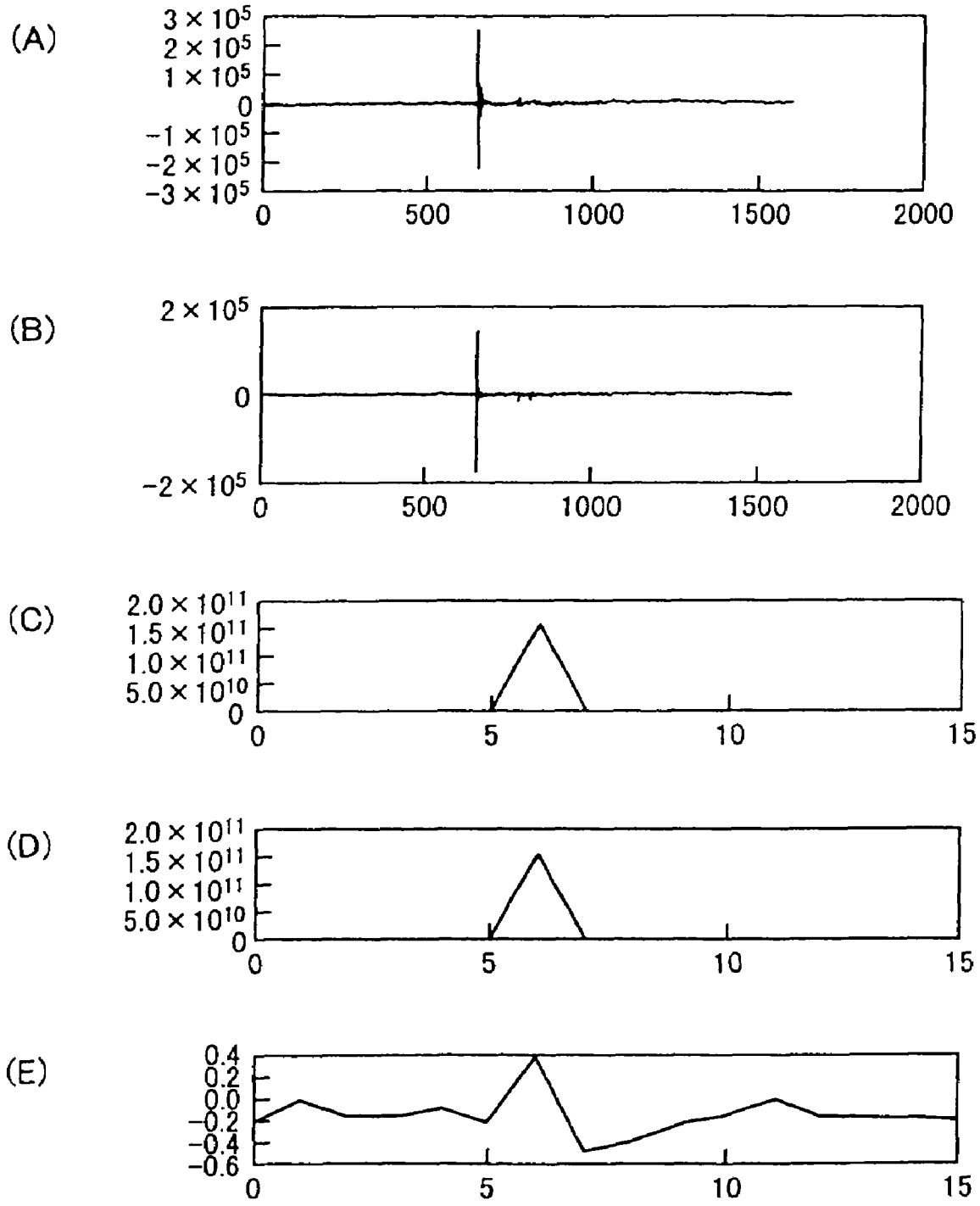
FIGS. 9A to 9E show a received sound signal with a unidirectivity pattern and a received sound signal with a bidirectivity pattern with respect to an impulse sound sources from the direction of 90° with respect to the negative direction on the X axis according to the microphone array system of the present invention.
Figure 10:
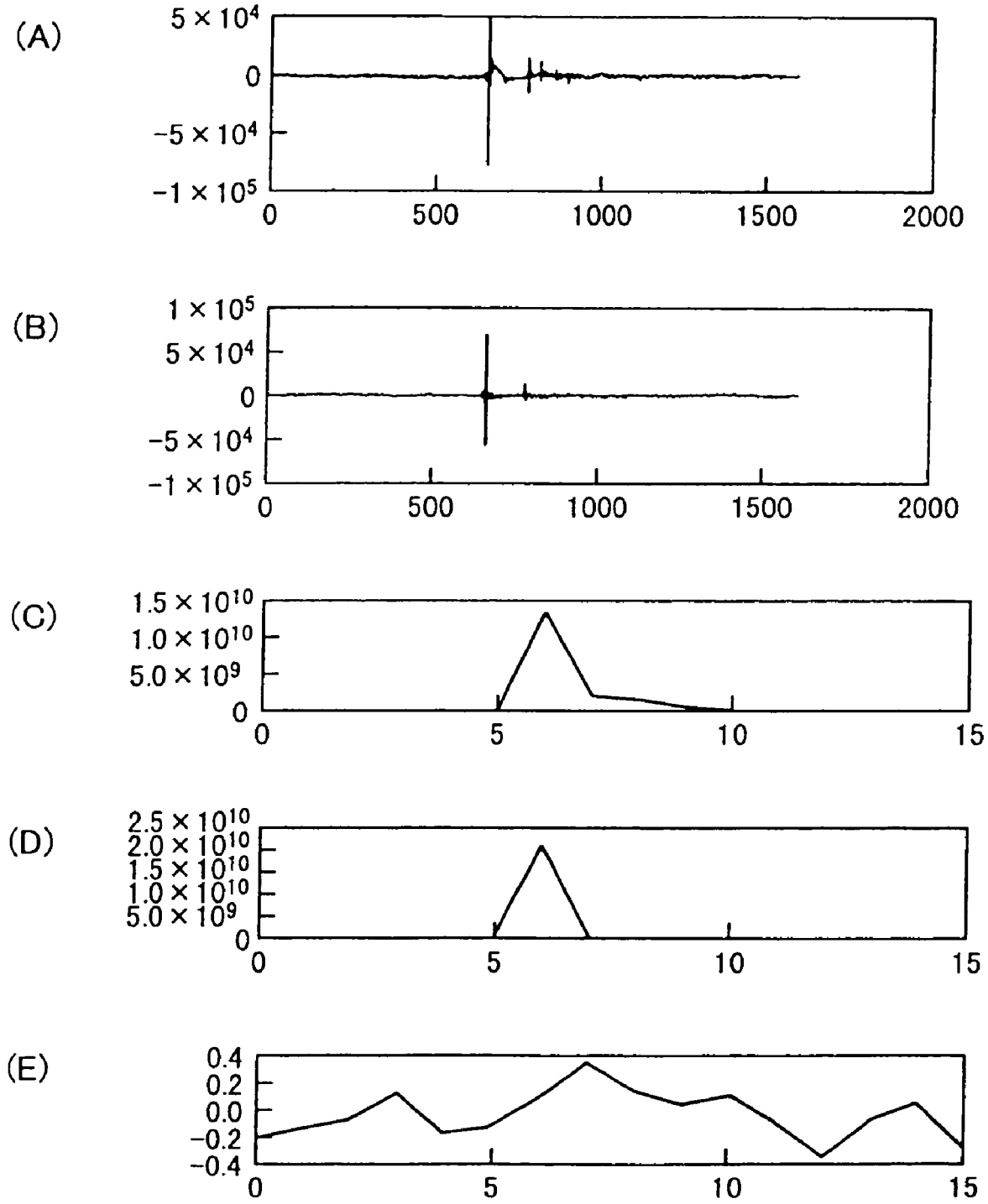
FIGS. 10A to 10E show a received sound signal with a unidirectivity pattern and a received sound signal with a bidirectivity pattern, with respect to an impulse sound sources from the direction of 180° with respect to the negative direction on the X axis according to the microphone array system of the present invention.
Figure 11:
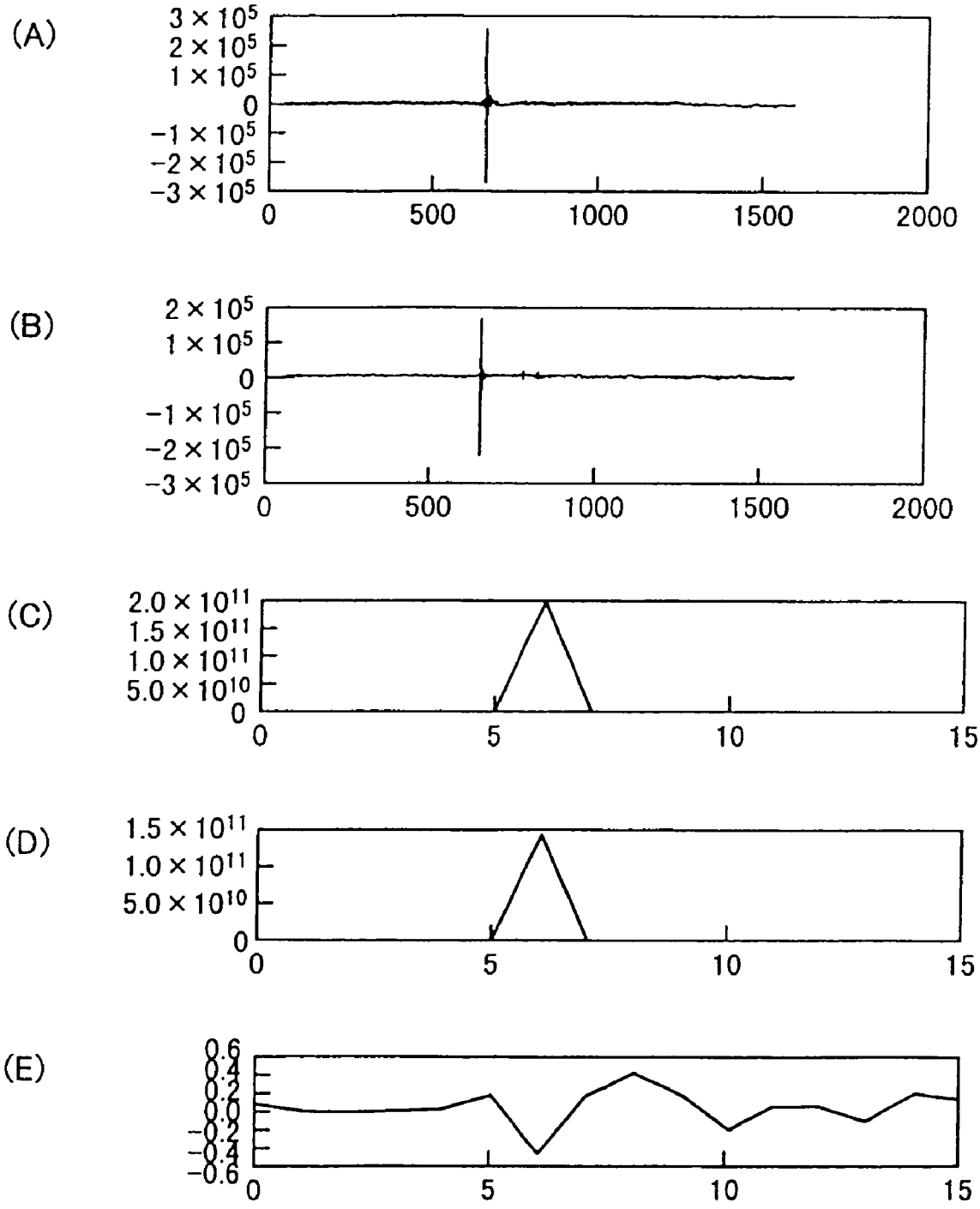
FIGS. 11A to 11E show a received sound signal with a unidirectivity pattern and a received sound signal with a bidirectivity pattern, with respect to an impulse sound sources from the direction of 270° with respect to the negative direction on the X axis according to the microphone array system of the present invention.

For simplification for description of the basic principle of the sound source direction detection, it is assumed that the sound input signal is an impulse signal. FIG. 8A shows a received sound signal with a unidirectivity pattern processed by the subtracter 121, and FIG. 8B shows a received sound signal with a bidirectivity pattern processed by the subtracter 122 with respect to an impulse sound source from the direction of 0° (front direction) in the negative direction on the X axis. In the same manner, FIGS. 9A, 10A, and 11A show received sound signals with a unidirectivity pattern processed by the subtracter 121, and FIGS. 9B, 10B, and 11B show a received sound signals with a bidirectivity pattern processed by the subtracter 122, with respect to an impulse sound sources from the directions of 90°, 180°, and 270°, respectively, in the negative direction on the X axis.

The power ratio calculating part 130 calculates the ratios of the powers of the output signals from the subtracters 121 and 122, namely, the powers with respect to each of the received sound signals of FIGS. 8A and 8B to 11A and 11B. In these figures, the diagram C shows the power of the received sound signal with a unidirectivity pattern processed by the subtracter 121, and the diagram D shows the power of the received sound signal with a bidirectivity pattern processed by the subtracter 122.

Next, the cross-correlation coefficient calculating part 140 calculates the cross-correlation coefficient between the received sound signal with a unidirectivity pattern processed by the subtracter 121 and the received sound signal with a bidirectivity pattern processed by the subtracter 122 in FIGS. 8A and 8B to 11A and 11B. The cross-correlation coefficient R can be calculated with the following equation.

Equation 1

$$R = \frac{\sum_{i=0}^{l-1} m(t_i)n(t_i)}{\sqrt{\sum_{i=0}^{l-1} m(t_i)^2}\sqrt{\sum_{i=0}^{l-1} n(t_i)^2}} \quad \text{Equation 1}$$

where m(ti) is a signal from the subtracter 121 and n(ti) is a signal from the subtracter 122, and 1 is the sampling number for calculation of the cross-correlation coefficient, and generally is a value more than several hundreds.

The cross-correlation coefficient R calculated in Equation 1 is from −1.0 to 1.0, and shows how similar the two signals m(ti) and n(ti) are. For example, the cross-correlation coefficient shows the followings.

In the case of R=1.0, m(ti) and n(ti) have the same amplitude and the phase (the signals having the same waveforms).

In the case of R=0.0, m(ti) and n(ti) are not correlated (not similar at all).

In the case of R=−1.0, m(ti) and n(ti) have the same amplitude and the opposite phase (the sign of the amplitude of the signals is opposite).

In FIGS. 8 to 11, the diagram E shows the result of calculating the cross-correlation coefficient according to Equation 1.

Now, the sound source direction is estimated by using the ratio of the power of the received sound signal with a unidirectivity pattern and the power of the received sound signal with a bidirectivity pattern and the cross-correlation coefficient therebetween. For example, the sound source direction can be estimated by determining which direction of 0°, 90°, 180° or 270° the sound source outputting the impulse is in, where the 0° direction corresponds to the negative direction on the X axis. This processing method will be described below.

First, the power ratio P of the unidirectivity and the bidirectivity is obtained. More specifically, P=(the power of the received sound signal with a bidirectivity pattern)/(the power of the received sound signal with a unidirectivity pattern) is obtained. Next, thresholds Tp, TR1 and TR2 as shown below are introduced so that the power ratio P of the unidirectivity and the bidirectivity and Tp are compared, and the cross-correlation coefficient R and TR1 and TR2 are compared. Herein, Tp is a positive value, TR1 is a negative value and TR2 is a positive value, and four patterns as shown in FIG. 12 are obtained by setting suitable thresholds, as described later.

In the examples with respect to the impulse sound source shown in FIGS. 8 to 11, if the thresholds are Tp=0.1, TR1=−0.2, and TR2=0.2, it can be estimated which direction of the sound source direction of 0°, 90°, 180° or 270° the sound source is in Furthermore, in the processing for estimating the sound source direction, the sound source direction can be obtained by a method other than the above-described method of determination with the thresholds. For example, if values corresponding to various directions from 0 to 360° of the sound source are previously obtained by using the power ratio P of the sound signal with a bidirectivity to the sound signal with a unidirectivity and the cross-correlation coefficient R as the parameters, the sound source direction can be determined based on the two parameters of the actually measured power ratio P of the bidirectivity to the unidirectivity and cross-correlation coefficient R.

Next, the noise suppressing function in a noise suppressing part 70 will be described. Noise can be erased by mutual subtraction of received sound signal components in the noise source direction among the received sound signals from the microphones. The sound source direction detecting part 60 can estimate the desired sound source direction, so that it is certainly possible that the noise component in the directions other than the desired sound source direction can be suppressed by directing the directivity to the direction of the desired sound source.

As described above, the microphone array system including a plurality of microphones on a personal computer, which is the platform, of the present invention can utilize selectively the functions of the directional sound signal calculating part 50, the sound source direction detecting part 60, and the noise suppressing part 70. Moreover, a plurality of functions can be utilized at the same time.

Embodiment 2

Similarly to the microphone array system of Embodiment 1, the microphone array system of Embodiment 2 includes a microphone array where a plurality of microphones are arranged along the axis directions, using a personal computer as the platform. The system performs signal processing of sound signals received at these microphones to generate received sound signals with a unidirectivity or bidirectivity pattern along the axis direction. The system includes a directional sound signal calculating function for calculating a directional sound signal with respect to an arbitrary direction based on the obtained received sound signals, and further include a plurality of sound signal processing functions including a sound source direction detecting function and a noise suppressing function. However, the microphone array system of Embodiment 1 is different from that of Embodiment 2 in that the non-directional microphones in Embodiment 1 are replaced by a plurality of unidirectional microphones in Embodiment 2.

Figure 13:
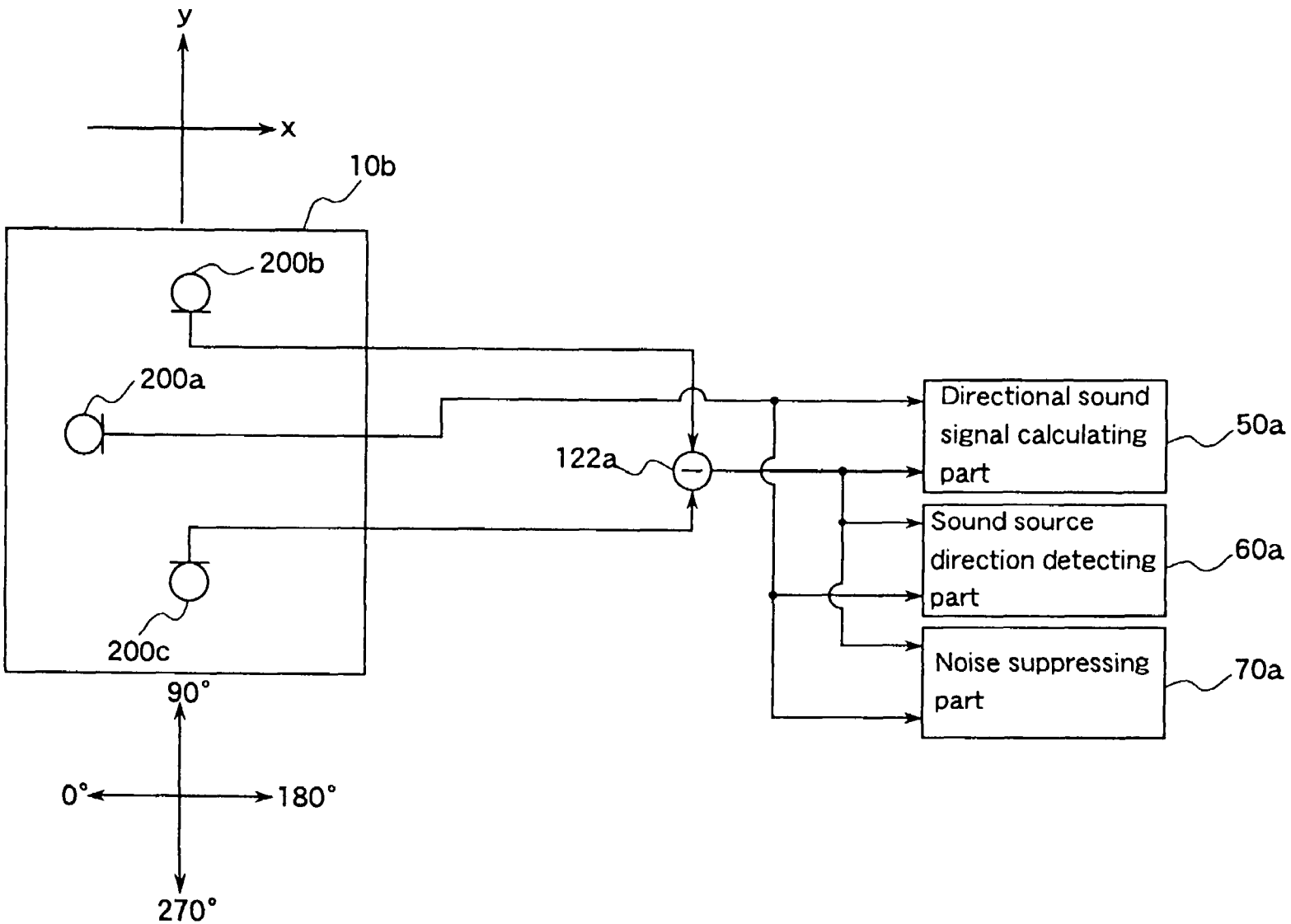
FIG. 13 is a diagram showing an example of the configuration of the microphone array system of Embodiment 2 of the present invention.

FIG. 13 is a diagram showing an example of the configuration of the microphone array system of Embodiment 2. A microphone array section 10*b* includes three unidirectional microphones 200*a* to 200*c* arranged in the negative direction on the X axis, and the positive and negative directions on the Y axis, namely, in the directions of 0°, 90° and 270°, respectively, so as to obtain received sound signals. The front direction of the microphone array system is set to be the negative direction on the X axis. In Embodiment 2, although a received sound signal with the unidirectivity pattern with respect to the direction of 0° is obtained, it is necessary to generate received sound signals with a bidirectivity pattern with respect to the positive and negative directions on the Y axis. The directional sound signal calculating part 50*a*, the sound source direction detecting part 60*a*, and the noise suppressing part 70*a* of Embodiment 2 have the following configurations. Numeral 122*a* denotes a subtracter.

In the first stage in the processing for calculating directional sound signals, a sound signal received from a microphone having a bidirectivity pattern to the positive and negative directions on the Y axis is generated. Next, in the second stage, a left (L) channel signal and a right (R) channel signal having a directivity to a specific direction are calculated based on the received sound signal with the unidirectivity pattern to the negative direction on the X axis and the received sound signal with the bidirectivity pattern to the positive and negative directions on the Y axis.

The process in the first stage will be described. The sound signal received from a microphone having a bidirectional pattern to the positive and negative directions on the Y axis is generated in the following manner. The subtracter 122*a* subtracts the received sound signal of the microphone 200*c* from the received sound signal of the microphone 200*b*. As a result, the received sound signal having a bidirectivity pattern to the negative and positive directions on the Y axis as shown in FIG. 5B is generated.

The process for calculating the left (L) channel signal and the right (R) channel signal in the second stage is the same as that in Embodiment 1, except that the input signal from the subtracter 121 in FIG. 4 of Embodiment 1 is replaced by an input signal from the unidirectional microphone 200*a*, and the input signal from the subtracter 122 in FIG. 4 of Embodiment 1 is replaced by an input signal from the subtracter 122*a*. Similarly to Embodiment 1, the result of subtracting the received sound signal with the bidirectivity pattern from the received sound signal with the unidirectivity pattern by the subtracter 123 is used as the left channel signal. The result of adding the received sound signal with the unidirectivity pattern and the received sound signal with the bidirectivity pattern by the adder 124 is used as the right channel signal.

The process of the sound source direction detecting part 60*a* and the process of the noise suppressing part 70*a* are the same as those in Embodiment 1, and therefore is omitted, where appropriate.

As shown in FIG. 13, each of the functions of the directional sound signal calculating part 50*a*, the sound source direction detecting part 60*a*, and the noise suppressing part 70*a* can be utilized together with the directional sound signal calculating function or other functions at the same time.

Embodiment 3

The microphone array system of Embodiment 3 includes a microphone array where a plurality of microphones are arranged along the axis directions, using a personal computer as the platform. The system performs signal processing of sound signals received at these microphones to generate received sound signals with a bidirectivity pattern along the axis direction. The system includes a directional sound signal calculating function for calculating a directional sound signal with respect to an arbitrary direction based on the obtained received sound signals, and further include a sound signal processing function such as a sound source direction detecting function and a noise suppressing function. In Embodiment 3, unidirectional microphones and bidirectional microphones are used.

Figure 14:
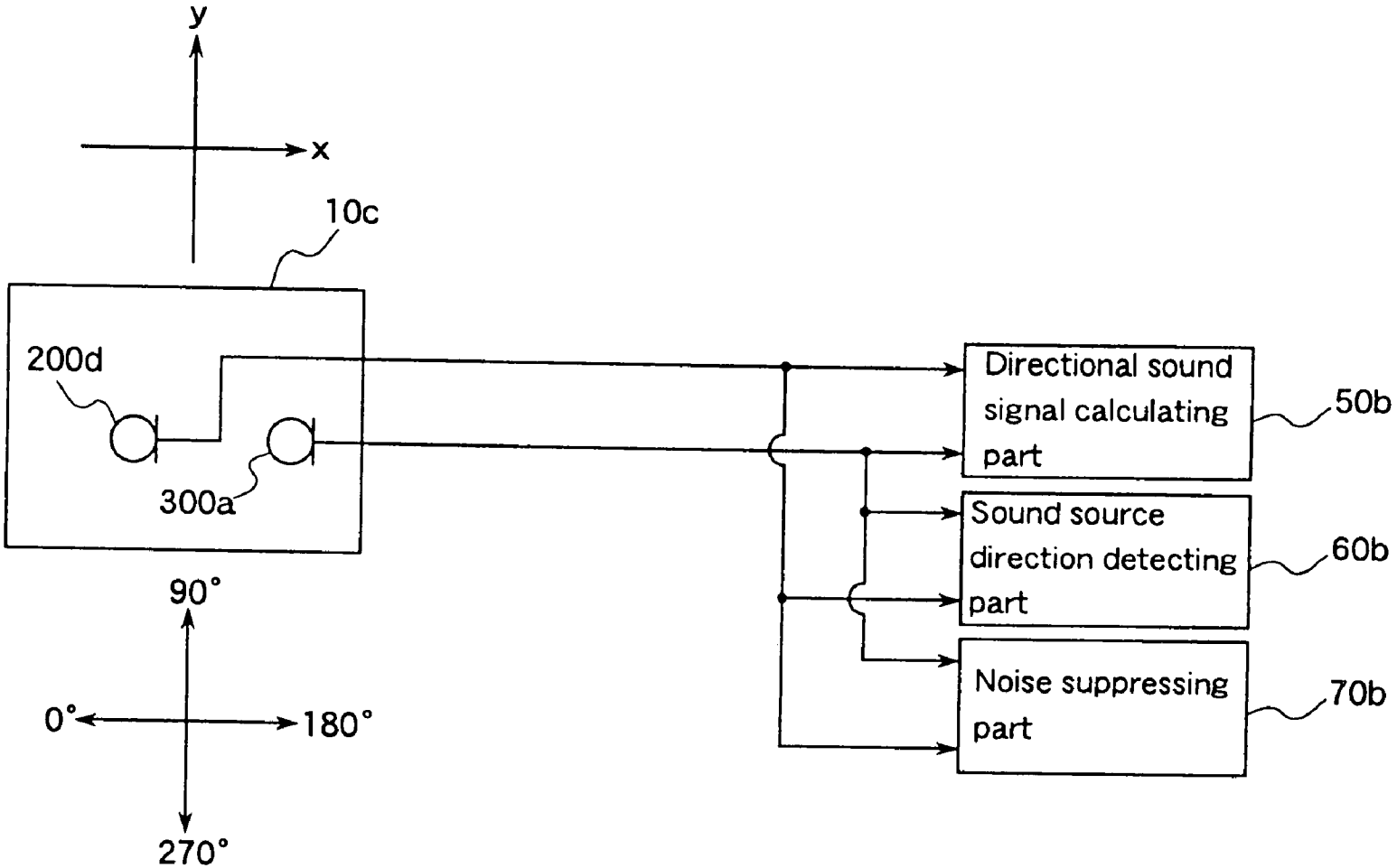
FIG. 14 is a schematic diagram showing an example of the basic configuration of the microphone array system of Embodiment 3 of the present invention.

FIG. 14 is a diagram showing an example of the configuration of the microphone array system of Embodiment 3. A microphone array section 10*c* includes a unidirectional microphone 200*d* having a directivity to the negative direction on the X axis (direction of 0°) and a bidirectional microphone 300*a* having directivities to the positive and negative directions on the Y axis (direction of 90° and 270°), so as to obtain received sound signals. In Embodiment 3, a received sound signal with the unidirectivity pattern with respect to the direction of 0° and a received sound signal with the bidirectivity pattern to the positive and negative directions on the Y axis are obtained from the microphones 200*d* and 300*a*. Therefore, there is no need of providing subtracters corresponding to the subtracters 121 and 122 in Embodiment 1 and the subtracter 222 in Embodiment 2. The directional sound signal calculating part 50*b*, the sound source direction detecting part 60*b*, and the noise suppressing part 70*b* are provided.

The process for calculating the left (L) channel signal and the right (R) channel signal by the directional sound signal calculating part 50*b* is the same as those in Embodiments 1 and 2, and also is the same as that of a conventional MS microphone, except the input signals as follows. The input signal from the subtracter 121 in FIG. 4 of Embodiment 1 is replaced by an input signal from the unidirectional microphone 200*d*, and the input signal from the subtracter 122 in FIG. 4 of Embodiment 1 is replaced by an input signal from the bidirectional microphone 300*a*. Similarly to Embodiment 1, the result of subtracting the received sound signal with the bidirectivity pattern from the received sound signal with the unidirectivity pattern by the subtracter 123 is used as the left channel signal. The result of adding the received sound signal with the unidirectivity pattern and the received sound signal with the bidirectivity pattern by the adder 124 is used as the right channel signal.

The process of the sound source direction detecting part 60*b* and the process of the noise suppressing part 70*b* are the same as those in Embodiment 1, and therefore is omitted, where appropriate.

Also in Embodiment 3, as shown in FIG. 14, each of the functions of the directional sound signal calculating part 50*b*, the sound source direction detecting part 60*b*, and the noise suppressing part 70*b* can be utilized together with the directional sound signal calculating function or other functions at the same time.

Embodiment 4

The microphone array system of Embodiment 4 includes a camera and a microphone array where a plurality of microphones are arranged along the axis directions, using a personal computer that controls the movable camera as the platform. The system performs signal processing of sound signals received at these microphones to generate received sound signals with a unidirectivity pattern or bidirectivity pattern along the axis directions. The system includes a directional sound signal calculating function for calculating a directional sound signal with respect to an arbitrary direction based on the obtained received sound signals. This embodiment provides a simple method for adjusting the directivity pattern of the microphones, which is performed by adjusting the delay sampling number and the gain of a delay unit.

Figure 15:
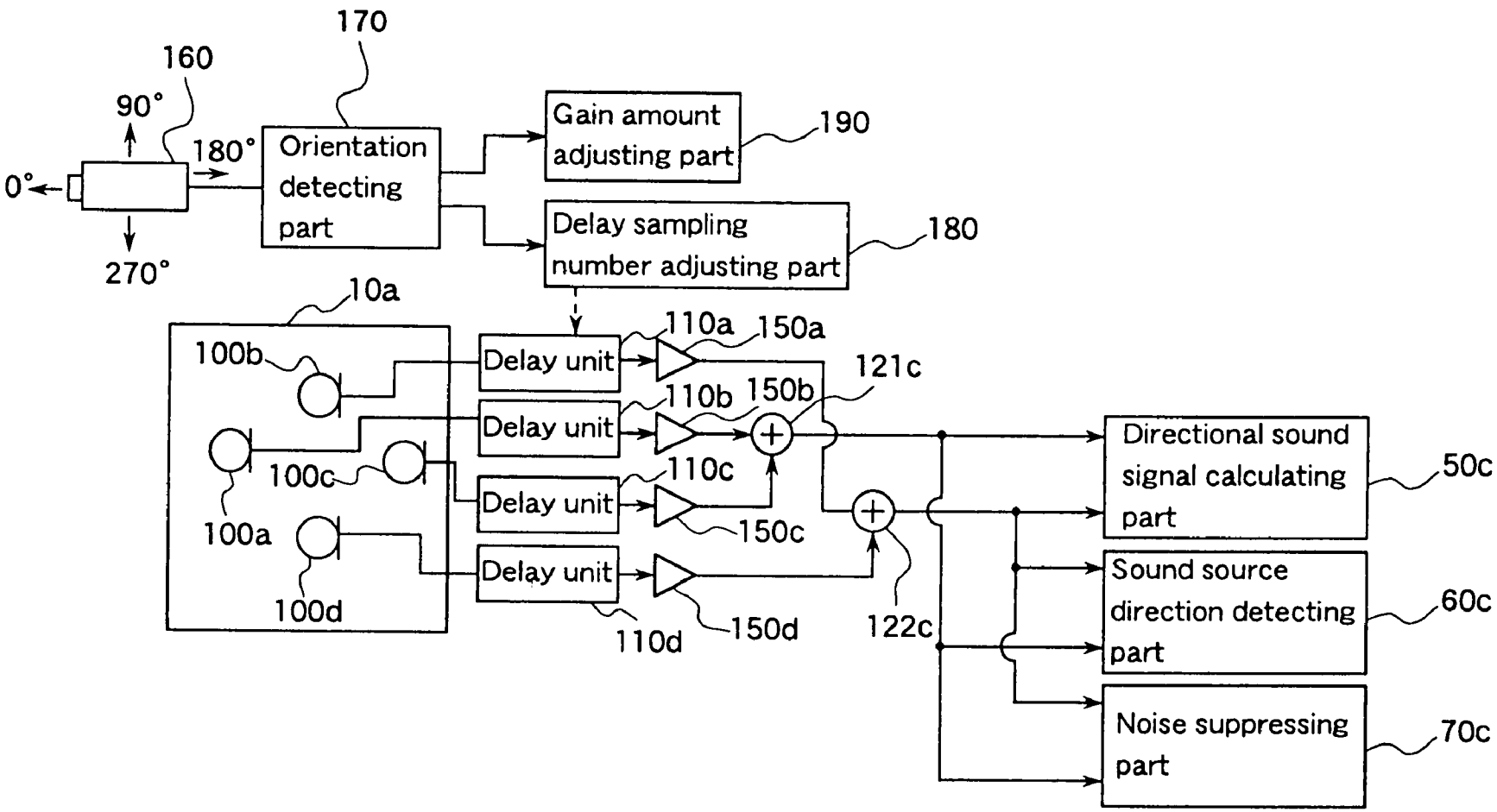
FIG. 15 is a schematic diagram showing an example of the basic configuration of the microphone array system of Embodiment 4 of the present invention.

FIG. 15 is a diagram showing an example of the configuration of the microphone array system of Embodiment 4.

A microphone array section 10*a* includes non-directional microphones 100*a* to 100*d* having directivities to the negative direction on the X axis (0°), the positive direction on the Y axis (90°), the positive direction on the X axis (180°) and the negative direction on the Y axis (270°). The outputs of the microphones 100*a* to 100*d* are connected to delay units 110*a* to 110*d*, respectively. The outputs of the delay units 110*a* to 110*d* are connected to gain units 150*a* to 150*d*, respectively. A movable camera 160 is rotated at any angle from 0° to 360° so that the directions in which the camera takes an image (hereinafter, referred to as "camera image capturing direction") can be changed. For convenience, the camera can be rotated at an angle of either one of 0°, 90°, 180° and 270°. A camera-orientation detector 170 detects the image capturing direction of the camera 160. For example, the orientation of the camera can be detected by presetting the reference direction of the axis of the housing of the camera with respect to the camera stand and detecting the amount of the rotation from the preset direction. A delay sampling number adjusting part 180 adjusts so that the delay sampling number of each of the delay units 110*a* to 110*d* corresponds to the delay sampling number shown in FIG. 16 based on the camera image capturing direction detected by the camera-orientation detector 170. A gain amount adjusting part 190 adjusts so that the amount of the gain of each of the gain units 150*a* to 150*d* corresponds to the amount of the gain shown in FIG. 16 based on the camera image capturing direction detected by the camera-orientation detector 170. Furthermore, as described later, the gain amount adjusting part 190 adjusts the gain amounts of gain units 150*e* and 150*f* in the directional sound signal calculating part 50*c*.

An adder 121*c* adds the output signal from the microphone 100*a* and the output signal from the microphone 100*c* that have been subjected to the delay and gain processes, and an adder 122*c* adds the output signal from the microphone 100*b* and the output signal from the microphone 100*d* that have been subjected to the delay and gain adjustment.

Figure 17:
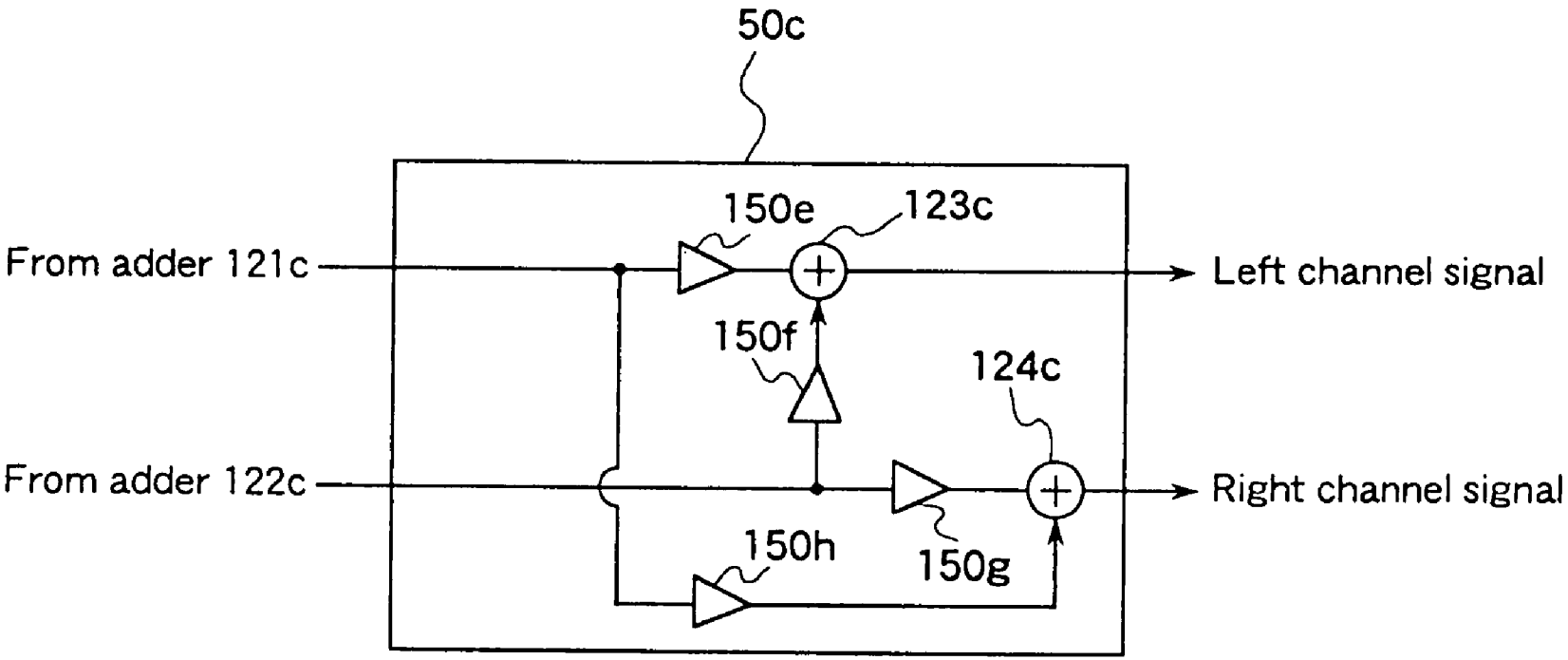
FIG. 17 shows an example of the configuration of the directional sound signal calculating part 50*c* of Embodiment 4 of the present invention.

Next, FIG. 17 shows an example of the configuration of the directional sound signal calculating part 50*c*. The directional sound signal calculating part 50*c* includes gain units 150*e* to 150*h* so that adjustment of the gain amount of +1.0 or −1.0 is performed in accordance with the image capturing direction of the camera 160, unlike the directional sound signal calculating part 50 in FIG. 4. The gain units 150*e* to 150*h* are adjusted by the gain amount adjusting part 190 so that the gain amounts thereof corresponds to those shown in FIG. 16. Numerals 123*c* and 124*c* are adders, and are the same as the adder 124 in FIG. 4.

The output from the adder 123*c* is used as the left channel output signal, and the output from the adder 124*c* is used as the right channel output signal.

The delay sampling number of the delay units and the gain amount of the gain units with respect to the orientation of the camera provide the following advantages. Regarding the adjustment of the delay units, the delay sampling number of the delay unit connected to the non-directional microphone arranged farthest from the orientation of the camera (that is, the delay unit 150*c* in the case where the camera image capturing direction is 0°, and the delay unit 150*d* in the case where the camera image capturing direction is 90°) is set to be 1, and the delay sampling number of the other delay units is set to be 0. Therefore, regardless of the orientation of the camera, either 0°, 90°, 180° or 270°, this configuration is equivalent to that of Embodiment 1 in FIG. 3 from the aspects of the sound source direction and the arrangement of the non-directional microphones and the delays. Next, regarding the gain adjustment of the gain units 150*a* to 150*d*, the gain amount of the gain units 150*a* to 150*d* is +1.0 or −1.0, which is determined so that the functions of the adder 121*c* and 122*c* are equivalent to the subtraction process by the adders 121 and 122 in FIG. 3, regardless of the direction of the camera.

Furthermore, regarding the gain units 150*e* to 150*h* in the directional sound signal calculating part 50*c*, the gain amounts are adjusted so that the operations of the adders 123*c* and 124*c* are equivalent to the subtraction process by the subtracter 123 and the addition process by the adder 124 of Embodiment 1 in FIG. 4, regardless of the orientation of the camera, respectively.

Thus, regardless of the image capturing direction of the movable camera, either 0°, 90°, 180° or 270°, the directional sound signal calculating part 50*c* that functions in the same manner as the directional sound signal calculating part 50 of Embodiment 1 can be obtained by adjusting the delay sampling number of the delay units 110*a* to 110*d* and the gain amount of the gain units 150*a* to 150*h*.

Next, the configuration of the sound source direction detecting part 60*c* will be described. The sound source is detected in the same manner as in Embodiment 1, which utilizes the cross-correlation coefficient of the powers of the received sound signal with a unidirectivity pattern to the front direction of the camera and the received sound signal with a bidirectivity pattern to the positive and negative directions on the Y axis. However, in this embodiment, the delay sampling number and the gain amount of the delay units are adjusted.

Figure 18:
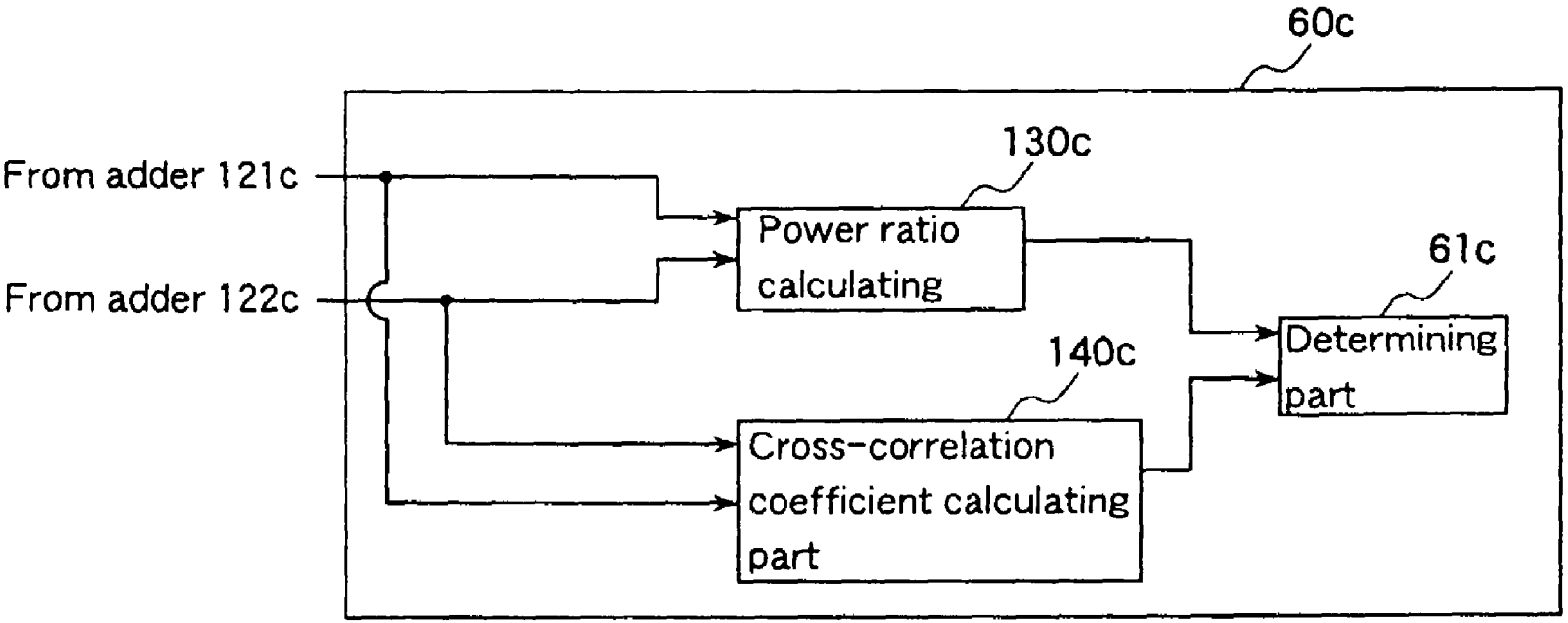
FIG. 18 shows an example of the configuration of the sound source direction detecting part 60*c* of Embodiment 4 of the present invention.

FIG. 18 shows an example of the configuration of the sound source direction detecting part 60*c*.

The sound source direction detecting part 60*c* includes a power ratio calculating part 130*c*, a cross-correlation coefficient calculating part 140*c*, and a determining part 61*c*. As shown in FIG. 18, the output signals from the adders 121*c* and 122*c* are input to the power ratio calculating part 130*c*, and the output signals from the adders 121*c* and 122*c* are input to the cross-correlation coefficient calculating part 140*c*. The functions of the components of the sound source direction detecting part 60*c* have the function of the corresponding components of the sound source direction detecting part 60 of Embodiment 1, and therefore will not be described further.

Thus, regardless of the image capturing direction of the movable camera, either 0°, 90°, 180° or 270°, the sound source direction detecting part 60*c* allows detection of whether or not the sound source is in the direction of the orientation of the camera.

The noise suppressing part 70*c* can have the same configuration as that of Embodiment 1 where the direction of the orientation of the camera is set to be the camera front by adjusting the delay sampling number and the gain amount in accordance with the orientation of the camera 160 in the same manner. The description thereof is omitted in this embodiment.

Embodiment 5

The microphone array system of Embodiment 5 includes a camera and a microphone array where a plurality of microphones are arranged along the axis directions, using a personal computer that controls a video camera as the platform. The system performs signal processing of sound signals at received these microphones and has a directional sound signal calculating function for calculating a directional sound signal with respect to the camera front direction and a memorandum recording function by the speech of the camera operator (so-called voice memo function) based on the obtained received sound signals.

In Embodiment 5, the sound source is located in either the camera front direction (0° direction) of a subject to be shot or the direction of the camera operator (e.g., 180° direction). The direction of the unidirectivity pattern for the directional sound signal calculating function of Embodiment 4 is usually set to be 0°, and the direction to be detected by the sound source direction detecting function is set to be 180°, which is the direction of the camera operator. When the speech of the camera operator is detected, namely when the sound source is in the 180° direction, the voice memo function is turned on so that the spoken sound of the camera operator is recorded. The directional received sound calculating function, the sound source direction detecting function and the sound enhancement processing function with respect to not only 0° and 180° as above, but also other arbitrary directions can be provided by combining the configurations of Embodiment 4.

Recording by the voice memo function is performed simply by recording the received sound signal with a unidirectivity pattern to the 180° direction. However, this can be performed by recording received sound signals from a non-directional microphone. In the following example, when the speech of the camera operator is detected, the voice memo function is turned on and the received sound signal with the unidirectivity pattern to the 180° direction is recorded so that the spoken sound of the camera operator is recorded in order to enhance the sound coming from the 180° direction.

Figure 19:
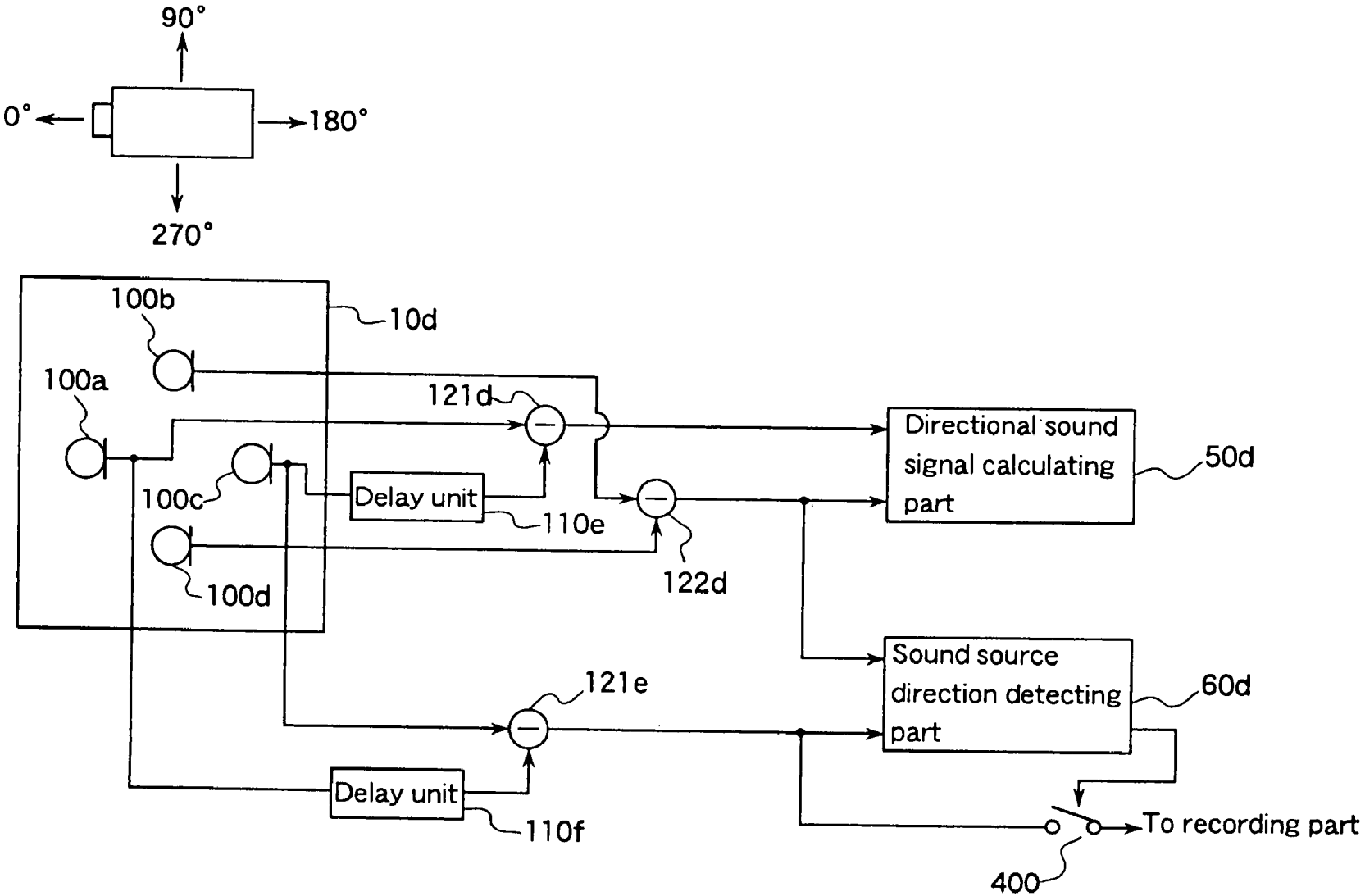
FIG. 19 is a schematic diagram showing an example of the basic configuration of the microphone array system of Embodiment 5 of the present invention.

FIG. 19 is a diagram showing an example of the configuration of the microphone array system of Embodiment 5.

Non-directional microphones 100*a* to 100*d* in a microphone array 10*d* are the same as those in Embodiment 4, except that the outputs from microphones 100*a* and 100*d* are processed by two systems. Numerals 110*e* and 110*f* denote delay units. The delay unit 110*e* delays the received sound signal of a microphone 100*c* by the delay sampling number. The delay unit 110*f* delays the received sound signal of a microphone 100*a* by the delay sampling number. Thus, the received sound signal processings of the microphones 100*a* and 100*c* are performed by two systems in parallel so as to generate received sound signals with two patterns of the unidirectivity pattern to the 0° direction and the unidirectivity pattern to the 180° direction. Subtracters 121*d* and 122*d* are the same as the subtracters 121 and 122 of Embodiment 1, and the results are input to a directional sound signal calculating part 50*d*. On the other hand, a subtracter 121*e* subtracts the received sound signal of the microphone 100*a* that is delayed by one sampling from the received sound signal of the microphone 100*c* so as to generate a received sound signal with a unidirectivity pattern to the 180°0 direction, and the result is input to a sound source direction detecting part 60*d*.

The directional sound signal calculating part 50*d* is the same as that in FIG. 4 of Embodiment 1, except that the input signal from the subtracter 121 in FIG. 4 of Embodiment 1 is replaced by an input signal from the subtracter 121*d*, and the input signal from the subtracter 122 in FIG. 4 of Embodiment 1 is replaced by an input signal from the subtracter 122*d*. Similarly to Embodiment 1, the result of subtracting the received sound signal with the bidirectivity pattern from the received sound signal with the unidirectivity pattern by the subtracter 123 is used as the left channel signal. The result of adding the received sound signal with the unidirectivity pattern and the received sound signal with the bidirectivity pattern by the adder 124 is used as the right channel signal.

The sound source detecting part 60*d* is the same as that in FIG. 7 of Embodiment 1, except that the input signal from the subtracter 121 in FIG. 7 is replaced by a signal from the subtracter 121*e*, and the input signal from the subtracter 122 in FIG. 7 is replaced by a signal from the subtracter 122*d*.

The sound source detecting part 60*d* detects whether or not the spoken sound is in the direction of the camera operator, namely, whether or not the sound source is in the 180° direction. In the case where the sound source is detected in that direction, a voice memo switch 400 is turned on, the signal from the subtracter 121*d* is delivered to a recording part for recording. The signal from the subtracter 121*d* has a directivity pattern to the camera operator, and therefore is recorded as a speech memorandum.

As described above, the voice memo of the camera operator can be obtained together with good image and recording of the subject of the camera by detecting the sound source by the sound source detecting function in the direction of the camera operator (180°) while receiving sounds with a unidirectivity pattern using the directional sound signal calculating function in the front direction of the movable camera (0°).

In the embodiments of the present invention, the number, the arrangement and the distance of microphones of the microphone array system are only illustrative for convenience and not limited to particular values.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A microphone array system including a plurality of microphones and a signal processing unit, comprising:

at least one microphone arranged along each axis direction; and a received sound signal processing part for performing processing of sound signals received at the plurality of microphones, having a directional sound signal calculating function, which is essential for estimating a directional sound signal to an arbitrary direction based on the received sound signal with a unidirectivity or bidirectivity pattern along each axis direction, and further having at least one function of other sound signal processing functions at the same time, wherein the plurality of microphones consist of only three unidirectional microphones, a first unidirectional microphone being directed to a positive direction on a first axis, and second and third unidirectional microphones being directed to positive and negative directions on a second axis that is orthogonal to the first axis, wherein the received sound signal processing part has a function for calculating a directional sound signal to an arbitrary direction based on a unidirectional received sound signal to a positive direction on the first axis and a bidirectional received sound signal to positive and negative directions on the second axis, and wherein the received sound signal processing part has a sound source direction detecting function for detecting a sound source direction, using a power in each axis direction of a sound signal calculated by the directional sound signal calculating function and a cross-correlation thereof; and further comprising the directional sound signal calculating function and the sound source direction detecting function at the same time, specifying a direction of a speaker by the sound source direction detecting function, calculating a directional sound signal to the direction of the speaker by the directional sound signal calculating function and performing desired sound enhancement processing to enhance the voice of the speaker in an arbitrary direction dynamically.

2. The microphone array system according to claim 1, comprising a movable camera, wherein an improvement for a directivity of a received sound signal to an image capturing direction of the movable camera and an improvement for a directivity of a received sound signal to a sound input from an operator of the movable camera are switched for implementation, using the directional sound signal calculating function and the sound source direction detecting function at the same time.

3. A microphone array system including a plurality of microphones and a signal processing unit, comprising:

at least one microphone arranged along each axis direction; and a received sound signal processing part for performing processing of sound signals received at the plurality of microphones, having a directional sound signal calculating function, which is essential for estimating a directional sound signal to an arbitrary direction based on the received sound signal with a unidirectivity or bidirectivity pattern along each axis direction, and further having at least one function of other sound signal processing functions at the same time, wherein the plurality of microphones consist of only one unidirectional microphone and only one bidirectional microphone, the unidirectional microphone being directed to a first axis direction, the bidirectional microphone being directed to a second axis direction that is orthogonal to the first axis direction, wherein the received sound signal processing part has a function for calculating a directional sound signal to an arbitrary direction based on a unidirectional received sound signal to a positive direction on the first axis and a bidirectional received sound signal to positive and negative directions on the second axis, and wherein the received sound signal processing part has a sound source direction detecting function for detecting a sound source direction, using a power in each axis direction of a sound signal calculated by the directional sound signal calculating function and a cross-correlation thereof; and further comprising the directional sound signal calculating function and the sound source direction detecting function at the same time, specifying a direction of a speaker by the sound source direction detecting function, calculating a directional sound signal to the direction of the speaker by the directional sound signal calculating function and performing desired sound enhancement processing to enhance the voice of the speaker in an arbitrary direction dynamically.

4. The microphone array system according to claim 3, comprising a movable camera, wherein an improvement for a directivity of a received sound signal to an image capturing direction of the movable camera and an improvement for a directivity of a received sound signal to a sound input from an operator of the movable camera are switched for implementation, using the directional sound signal calculating function and the sound source direction detecting function at the same time.

5. A method for performing sound processing using a microphone array system including a plurality of microphones and a signal processing unit, wherein at least one microphone is arranged along each axis direction, the method comprising the steps of:

performing processing of sound signals received at the plurality of microphones, wherein the received sound signal processing step includes a step of calculating a directional sound signal to an arbitrary direction based on the received sound signal with a unidirectivity or bidirectivity pattern along each axis, which is essential, wherein the plurality of microphones consist of only three unidirectional microphones, a first unidirectional microphone being directed to a positive direction on a first axis, and second and third unidirectional microphones being directed to positive and negative directions on a second axis that is orthogonal to the first axis, wherein the received sound signal processing step includes a step of calculating a directional sound signal to an arbitrary direction based on a unidirectional received sound signal to a positive direction on the first axis and a bidirectional received sound signal to positive and negative directions on the second axis, wherein the received sound signal processing step further includes a step of detecting a sound source direction using a power in each axis direction of a sound signal calculated in the directional sound signal calculating step and a cross-correlation thereof, and wherein the directional sound signal calculating step and the sound source direction detecting step are performed at the same time, thereby specifying a direction of a speaker by the sound source direction detecting step, calculating a directional sound signal to the direction of the speaker by the directional sound signal calculating step and performing desired sound enhancement processing to enhance the voice of the speaker in an arbitrary direction dynamically.

6. A method for performing sound processing using a microphone array system including a plurality of microphones and a signal processing unit, wherein at least one microphone is arranged along each axis direction, the method comprising the steps of:

performing processing of sound signals received at the plurality of microphones, wherein the received sound signal processing step includes a step of calculating a directional sound signal to an arbitrary direction based on the received sound signal with a unidirectivity or bidirectivity pattern along each axis, which is essential, wherein the plurality of microphones consist of only one unidirectional microphone and only one bidirectional microphone, the unidirectional microphone being directed to a first axis direction, and the bidirectional microphone being directed to a second axis direction that is orthogonal to the first axis direction, wherein the received sound signal processing step includes a step of calculating a directional sound signal to an arbitrary direction based on a unidirectional received sound signal to a positive direction on the first axis and a bidirectional received sound signal to positive and negative directions on the second axis, wherein the received sound signal processing step further includes the step of detecting a sound source direction using a power in each axis direction of a sound signal calculated in the directional sound signal calculating step and a cross-correlation thereof, and wherein the directional sound signal calculating step and the sound source direction detecting step are performed at the same time, thereby specifying a direction of a speaker by the sound source direction detecting step, calculating a directional sound signal to the direction of the speaker by the directional sound signal calculating step and performing desired sound enhancement processing to enhance the voice of the speaker in an arbitrary direction dynamically.

* * * * *